US008366261B2

(12) United States Patent
Yamada et al.

(10) Patent No.: US 8,366,261 B2
(45) Date of Patent: Feb. 5, 2013

(54) INKJET PRINTER

(75) Inventors: Ryuji Yamada, Tomi (JP); Yoshiki Onozawa, Tomi (JP); Akira Minemura, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 12 days.

(21) Appl. No.: 12/900,503

(22) Filed: Oct. 8, 2010

(65) Prior Publication Data

US 2011/0074864 A1 Mar. 31, 2011

Related U.S. Application Data

(63) Continuation of application No. PCT/JP2009/069727, filed on Nov. 20, 2009.

(30) Foreign Application Priority Data

Nov. 28, 2008 (JP) ..... 2008-304825

(51) Int. Cl.
*B41J 2/015* (2006.01)
*B41J 2/01* (2006.01)

(52) U.S. Cl. ..... 347/102; 347/20

(58) Field of Classification Search ..... 347/20, 347/101–102
See application file for complete search history.

(56) References Cited

U.S. PATENT DOCUMENTS

| | | | | |
|---|---|---|---|---|
| 4,388,511 A | | 6/1983 | Sander et al. | |
| 4,629,849 A | * | 12/1986 | Mizutani et al. | 219/749 |
| 5,220,346 A | | 6/1993 | Carreira et al. | |
| 5,422,463 A | * | 6/1995 | Gooray et al. | 219/694 |
| 2007/0115326 A1 | * | 5/2007 | Yokoi et al. | 347/52 |

FOREIGN PATENT DOCUMENTS

| | | |
|---|---|---|
| GB | 1050493 | 12/1966 |
| JP | 57-11496 | 1/1982 |
| JP | 7-314661 | 12/1995 |
| JP | 3233238 B2 | 9/2001 |
| JP | 2001-301131 | 10/2001 |
| JP | 2003-022890 | 1/2003 |
| JP | 2004-334176 | 11/2004 |
| JP | 2007-083566 | 4/2007 |

OTHER PUBLICATIONS

International Search Report for International Application No. PCT/JP2009/069727, Dec. 22, 2009.
Japanese Office Action for corresponding JP Application No. 2008-304825, Aug. 3, 2010.
Japanese Office Action for corresponding JP Application No. 2008-304825, Feb. 22, 2011.

* cited by examiner

*Primary Examiner* — Jason Uhlenhake
(74) *Attorney, Agent, or Firm* — Ditthavong Mori & Steiner, P.C.

(57) ABSTRACT

An inkjet printer includes an ejector, a waveguide, an electromagnetic wave supplier, a rotating reflector, and a ventilator. The ejector ejects ink onto a medium. Through the waveguide, the medium onto which the ink was ejected passes. The waveguide has a starting end part and a terminal end part. The electromagnetic wave supplier is provided at the starting end part of the waveguide to supply an electromagnetic wave to the waveguide. The rotating reflector is provided at the terminal end part of the waveguide and rotatable to reflect the electromagnetic wave supplied by the electromagnetic wave supplier. The ventilator ventilates an inside of the waveguide.

20 Claims, 18 Drawing Sheets

INKJET PRINTER

CROSS-REFERENCE TO RELATED APPLICATIONS

The present application is a continuation application of International Application No. PCT/JP2009/069727, filed Nov. 20, 2009, which claims priority to Japanese Patent Application No. 2008-304825, filed Nov. 28, 2008. The contents of these applications are incorporated herein by reference in their entirety.

BACKGROUND OF THE INVENTION

1. Technical Field

The present invention relates to an inkjet printer.

2. Background Art

In an inkjet printer, printing is performed on one surface or on front and rear faces of a sheet-shaped medium (recording medium) such as paper, silk, cotton or vinyl chloride by ejecting a dye-based ink such as an acid dye, a reactive dye or a direct dye, or an organic solvent type pigment-based ink such as a solvent ink. In this type inkjet printer, especially in industrial fields, it is important that a medium on which ink has been ejected is efficiently dried in order to quickly and easily perform shipment, delivery and the like of the medium after having been printed.

Therefore, in Japanese Patent Laid-Open No. 2003-022890, an inkjet printer is disclosed in which a medium is passed through a waveguide to which microwave is supplied and, as a result, the ink ejected onto the medium is dried.

SUMMARY OF THE INVENTION

According to one aspect of the present invention, an inkjet printer includes an ejector, a waveguide, an electromagnetic wave supplier, a rotating reflector, and a ventilator. The ejector ejects ink onto a medium. Through the waveguide, the medium onto which the ink was ejected passes. The waveguide has a starting end part and a terminal end part. The electromagnetic wave supplier is provided at the starting end part of the waveguide to supply an electromagnetic wave to the waveguide. The rotating reflector is provided at the terminal end part of the waveguide and rotatable to reflect the electromagnetic wave supplied by the electromagnetic wave supplier. The ventilator ventilates an inside of the waveguide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

An inkjet printer in accordance with an embodiment of the present invention will be described in detail below with reference to the accompanying drawings. In all drawings, the same reference signs are used for the same portions or corresponding portions.

Figure 1:
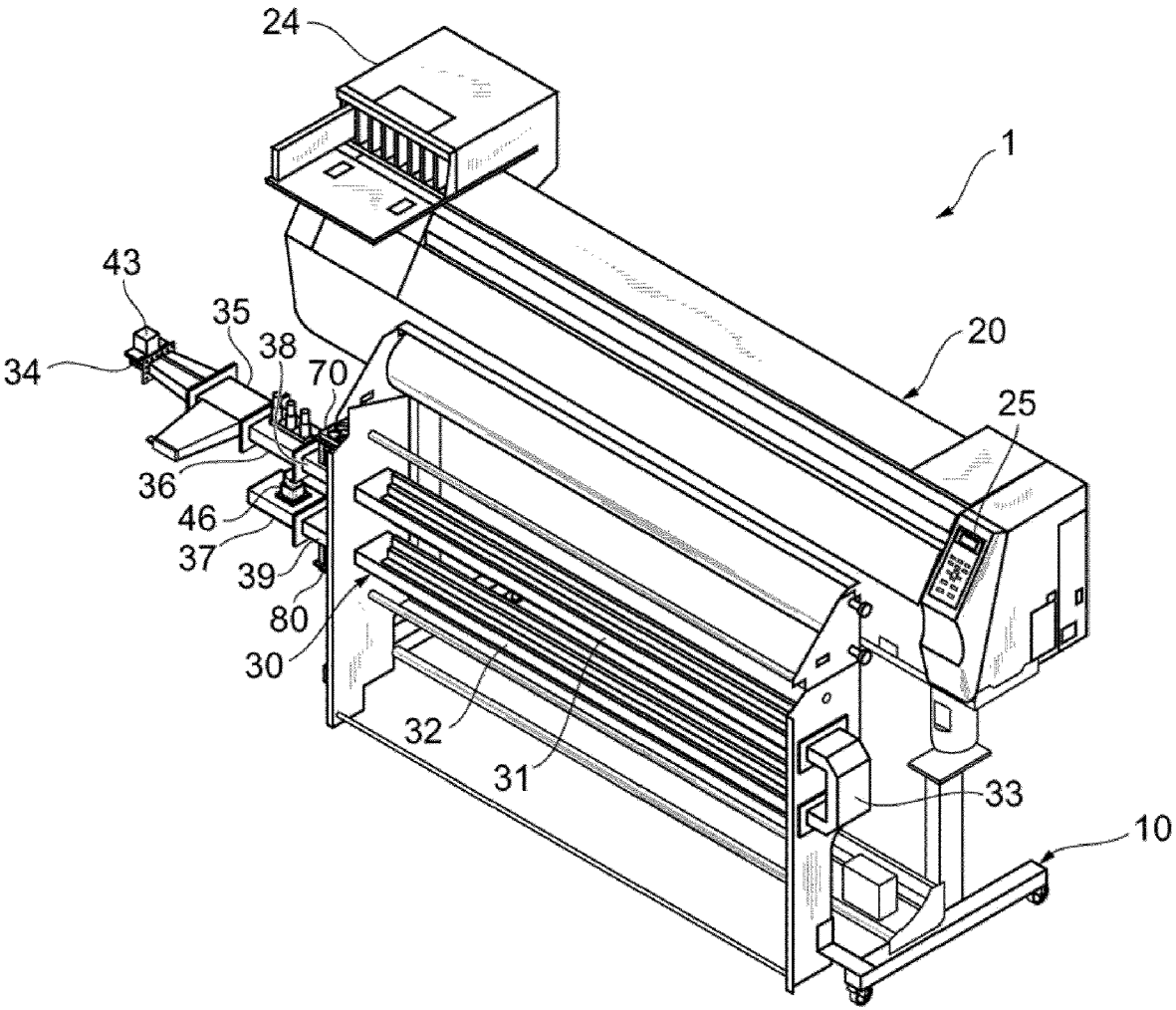
FIG. 1 is a perspective view showing an inkjet printer in accordance with an embodiment of the present invention.
Figure 2:
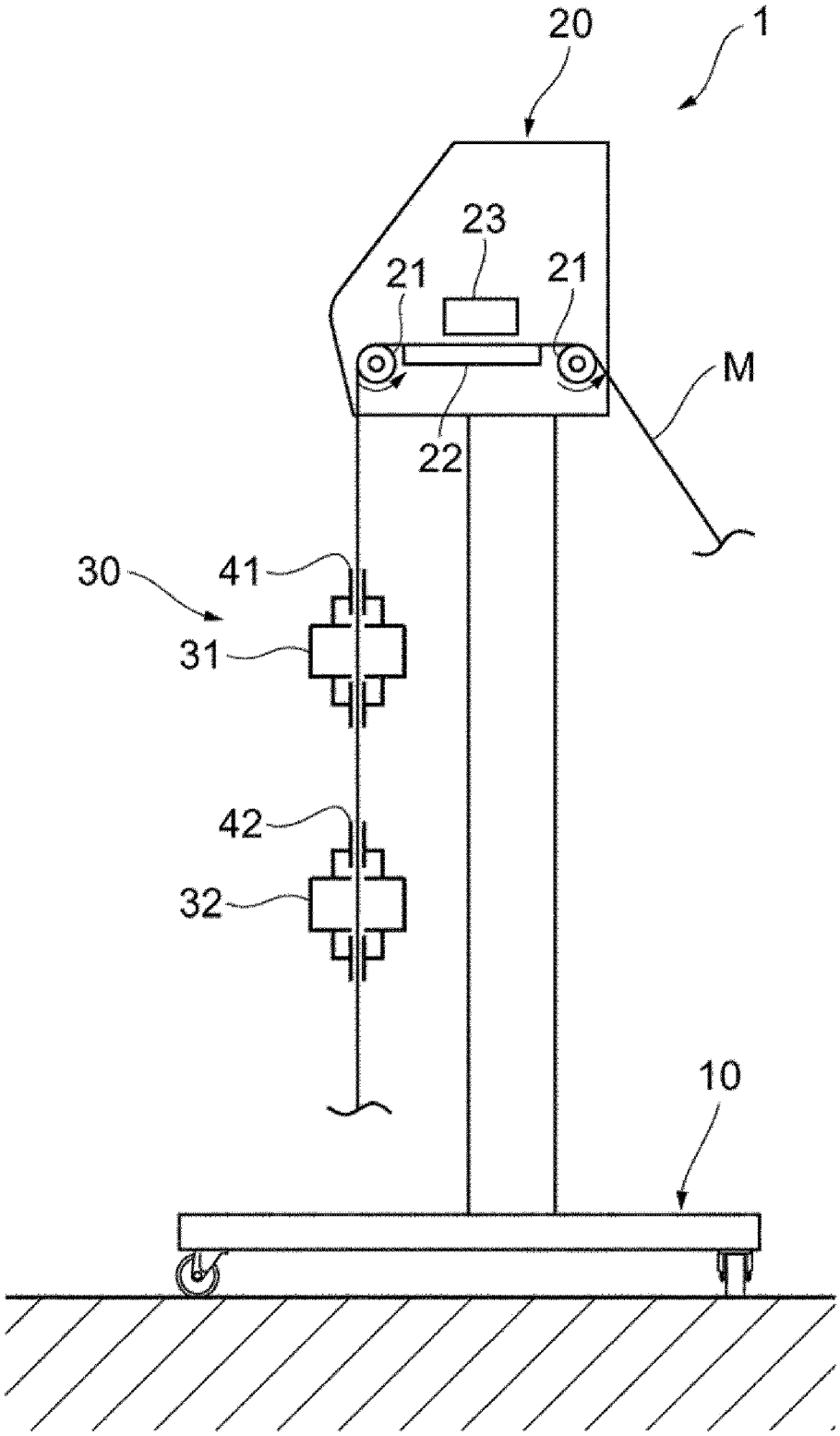
FIG. 2 is a cross-sectional view showing the inkjet printer in FIG. 1.

FIG. 1 is a perspective view showing an inkjet printer in accordance with an embodiment of the present invention and FIG. 2 is a cross-sectional view showing the inkjet printer shown in FIG. 1.

As shown in FIGS. 1 and 2, the inkjet printer 1 in accordance an embodiment of the present invention includes a printer part 20, which is mounted on a base 10 and where ink is ejected onto a medium "M", and a waveguide 30 where the ink ejected onto the medium "M" in the printer part 20 is dried. A sheet-shaped printing medium is used as the medium "M", which is, for example, structured of paper, silk, cotton, vinyl chloride or the like. Further, a dye-based ink such as an acid dye, a reactive dye or a direct dye, or an organic solvent type ink such as a solvent ink is used as the ink.

The printer part 20 includes feeding rollers 21 for feeding the medium "M", an inkjet head 23 from which the ink is ejected onto the medium "M" on a platen 22, a toner part 24 which accommodates ink tanks storing the inks that are ejected from the ink jet head 23, and an operation part 25 to which a user performs input operations.

Figure 3:
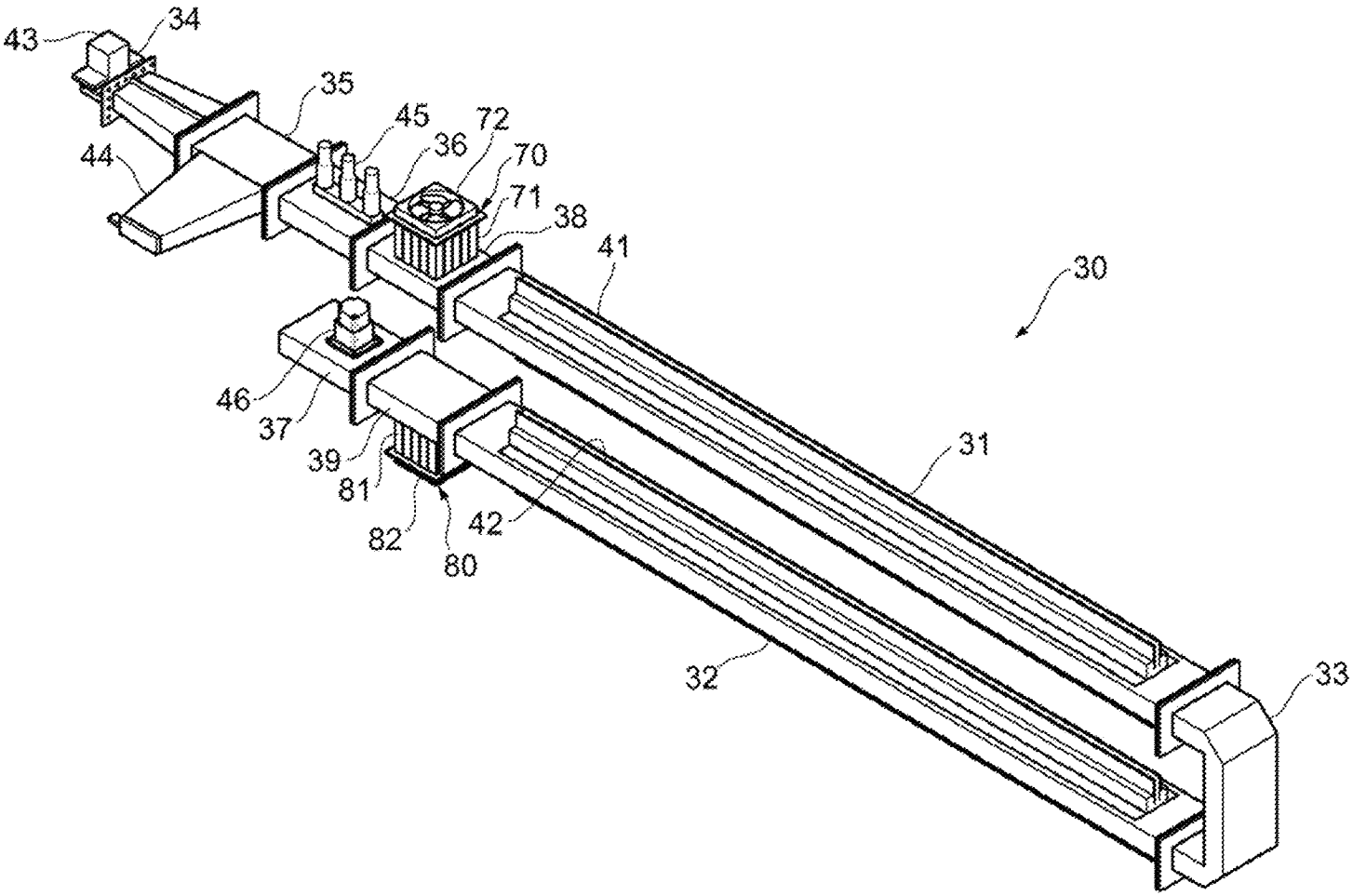
FIG. 3 is a perspective view showing a waveguide.
Figure 4:
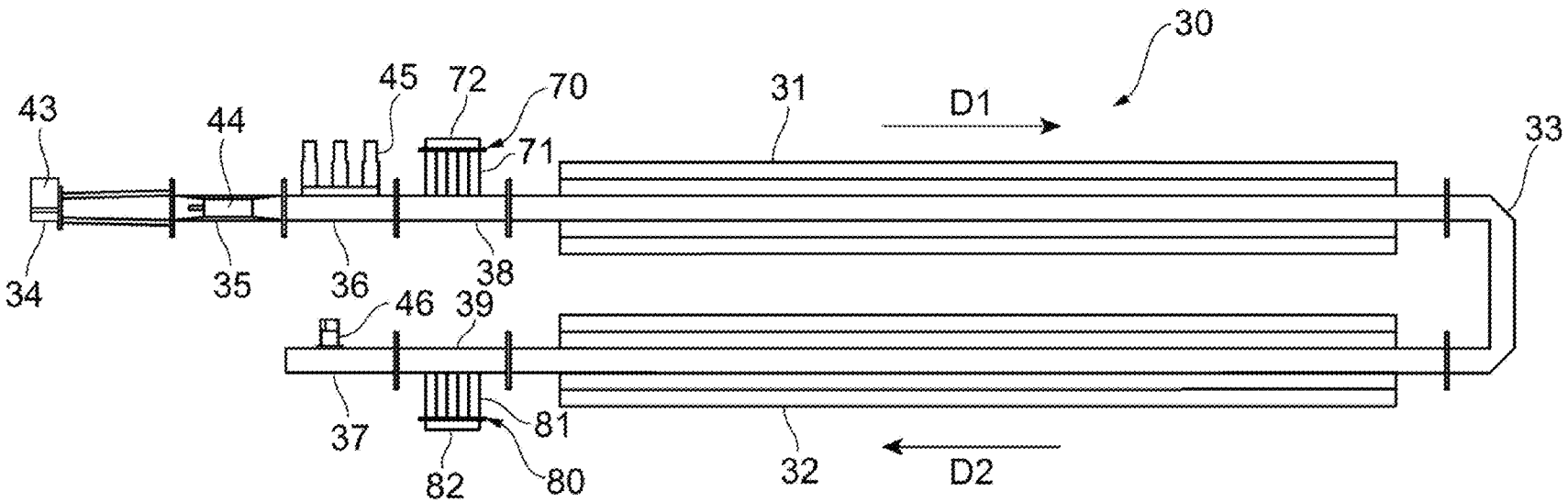
FIG. 4 is a plan view showing the waveguide.

FIG. 3 is a perspective view showing the waveguide and FIG. 4 is a plan view showing the waveguide. As shown in FIGS. 3 and 4, the waveguide 30 is formed in an elongated shape whose cross section is rectangular and is structured in a two-stage shape where its center part is bent in a substantially "U"-shape. The waveguide 30 is structured of waveguide main bodies 31 and 32, a bent part 33, an electromagnetic wave supply part 34, a propagation preventing part 35, a matching part 36, a rotating reflection part 37 and ventilation parts 38 and 39. In this embodiment, each of the waveguide main bodies 31 and 32, the bent part 33, the electromagnetic wave supply part 34, the propagation preventing part 35, the rotating reflection part 37 and the ventilation parts 38 and 39 is formed with flange parts on its end faces. The flange parts are overlapped and connected with each other and, as a result, the electromagnetic wave supply part 34 and the propagation preventing part 35 are connected with each other, the propagation preventing part 35 and the matching part 36 are connected with each other, the matching part 36 and the ventilation part 38 are connected with each other, the ventilation part 38 and the waveguide main body 31 are connected with each other, the waveguide main body 31 and the bent part 33 are connected with each other, the bent part 33 and the waveguide main body 32 are connected with each other, the waveguide main body 32 and the ventilation part 39 are connected with each other, the ventilation part 39 and the rotating reflection part 37 are connected with each other respectively.

The waveguide main bodies 31 and 32 are formed in an elongated shape and the ink ejected onto the medium "M" is dried in the waveguide main bodies 31 and 32 by microwave. Therefore, the waveguide main bodies 31 and 32 are respectively formed with insertion openings 41 and 42 and the medium "M" onto which the ink is ejected by the inkjet head 23 is inserted into the waveguide main bodies 31 and 32 through the insertion openings 41 and 42.

The bent part 33 is formed in a substantially "U"-shape and is disposed between the waveguide main body 31 and the waveguide main body 32 for connecting the waveguide main body 31 with the waveguide main body 32 in a two-stage shape in the upper and lower direction.

The electromagnetic wave supply part 34 is disposed at the starting end part of the waveguide 30 and a magnetron 43 for generating microwave is attached to the electromagnetic wave supply part 34. The magnetron 43 which generates microwave supplies the microwave to the waveguide 30 and the microwave is carried in the waveguide 30 in forward directions "D1" and "D2". In this embodiment, a frequency of the microwave which is supplied to the waveguide 30 from the magnetron 43 is set to be "λg".

The propagation preventing part 35 is disposed between the waveguide main body 31 and the electromagnetic wave supply part 34 and an isolator 44 which propagates the microwave only in one direction is attached to the propagation preventing part 35. The isolator 44 is structured of a well-known isolator, which propagates the microwave from the electromagnetic wave supply part 34 to the waveguide main body 31 but prevents propagation of the microwave from the waveguide main body 31 to the electromagnetic wave supply part 34.

The matching part 36 is disposed between the propagation preventing part 35 and the ventilation part 38 and a microwave matcher 45 is attached to the matching part 36. The microwave matcher 45 is structured of a well-known microwave matcher, which performs impedance matching in the matching part 36 and, as a result, a reflecting electric power of the microwave supplied from the magnetron 43 is reduced to improve absorption efficiency of the microwave to the ink that is ejected onto the medium "M".

The rotating reflection part 37 is disposed at the terminal end part of the waveguide 30 to perform an operation of reflection termination of the microwave which is supplied into the waveguide 30.

Figure 5:
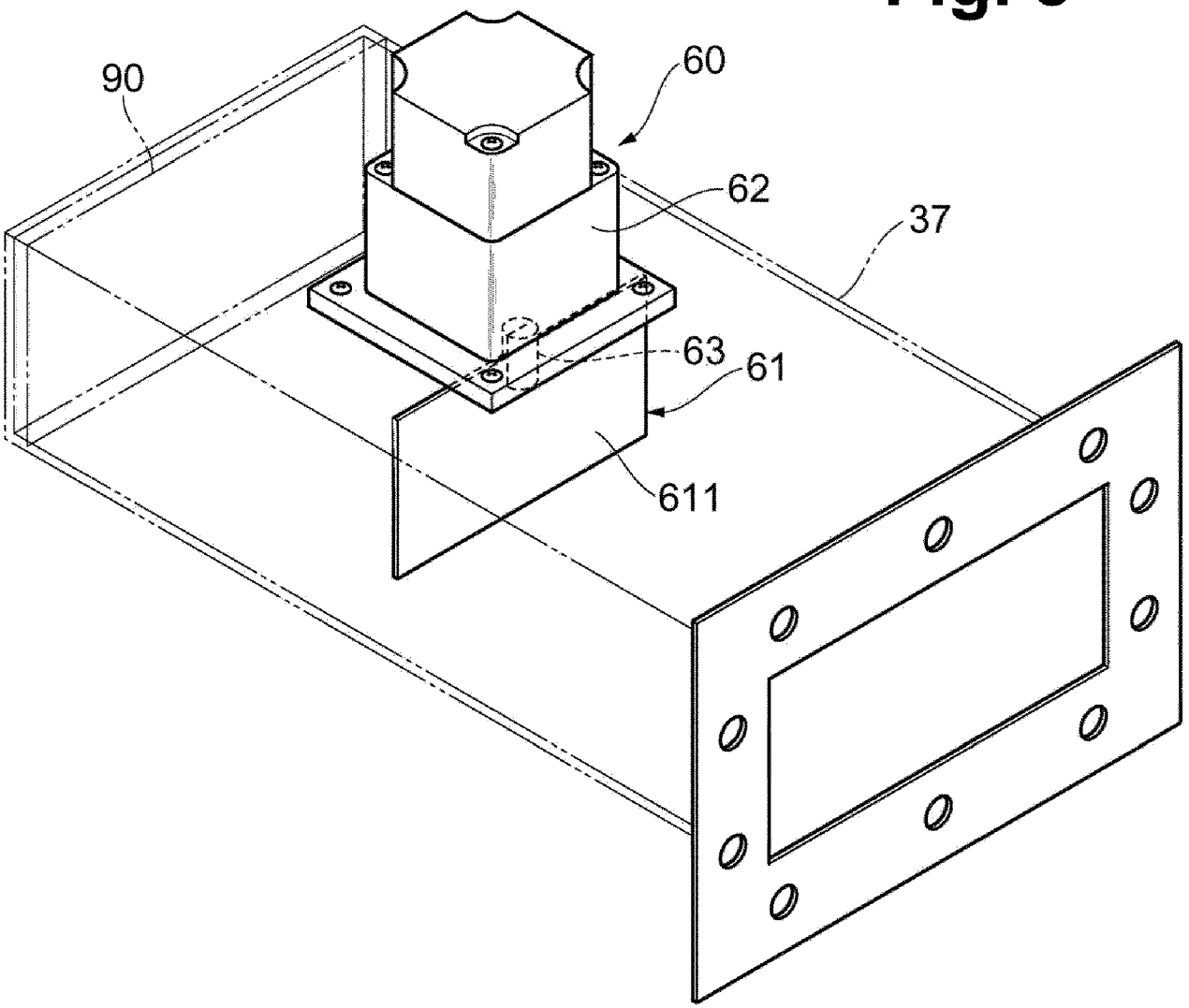
FIG. 5 is a perspective transparent view showing a rotating reflection part.
Figure 6:
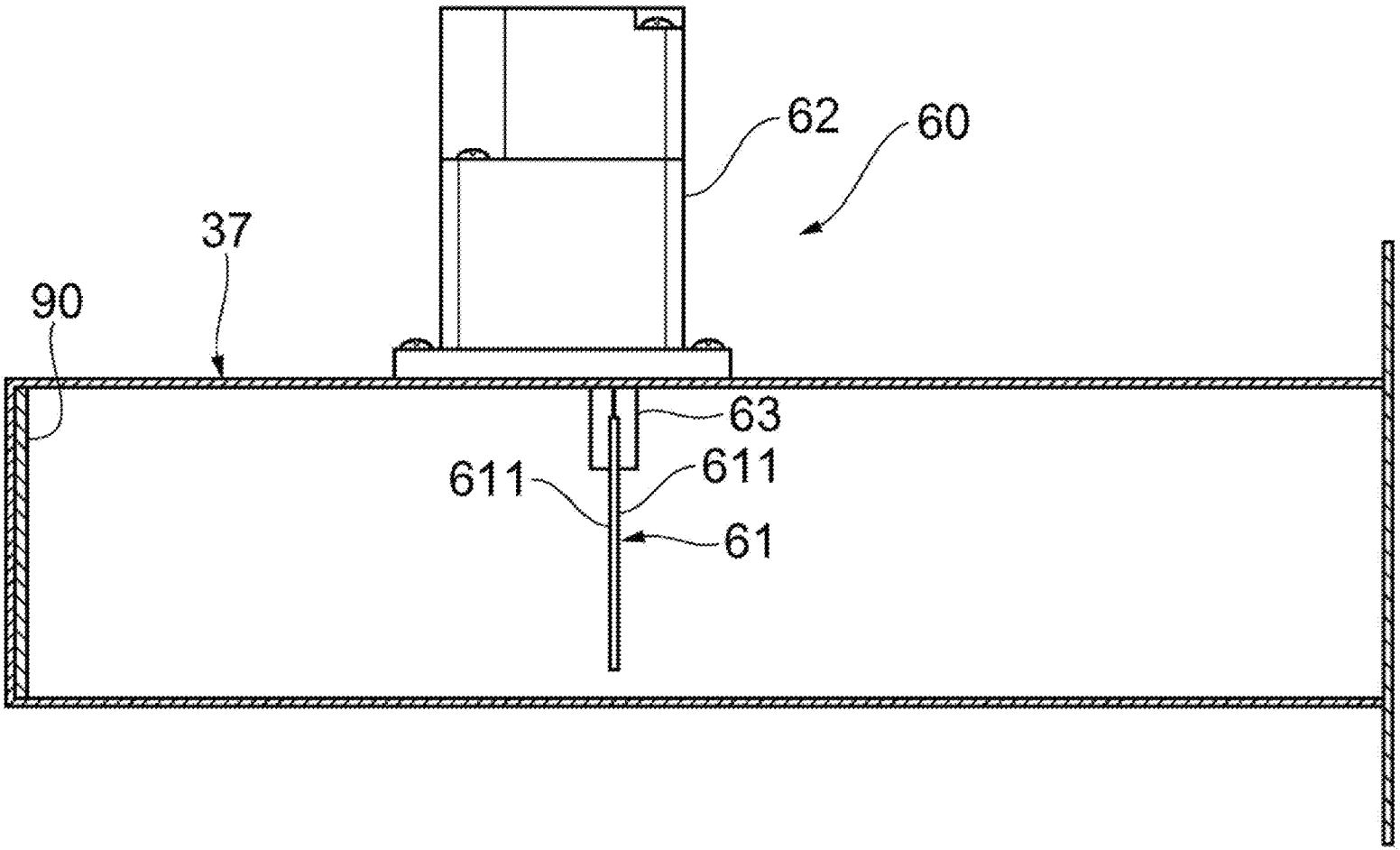
FIG. 6 is a longitudinal sectional view showing the rotating reflection part.

FIG. 5 is a perspective transparent view showing the rotating reflection part and FIG. 6 is a longitudinal sectional view showing the rotating reflection part. As shown in FIGS. 5 and 6, the rotating reflection part 37 is provided with a propeller member 60 and a short-circuiting plate 90.

The propeller member 60 reflection-terminates the microwave which is supplied from the magnetron 43 and the propeller member 60 varies and disturbs a standing wave generated in the inside of the waveguide 30. Therefore, the propeller member 60 is structured of a propeller part 61 and a motor part 62 for rotating the propeller part 61.

The propeller part 61 is disposed in the inside of the rotating reflection part 37 and is formed in a flat plate shape and substantially the same shape as the inner cross section of the rotating reflection part 37 in a separated state from an inner wall of the rotating reflection part 37 by a predetermined distance. Further, the propeller part 61 is formed with reflection faces 611 which reflect the microwave on its front and rear faces. The reflection face 611 is formed in a shape which satisfactorily reflects the microwave and is formed in a flat face shape or a curved face shape that is curved in a convex shape or a concave shape. The propeller part 61 is preferably formed of metal and, especially, the propeller part 61 is preferably formed of SUS (stainless steel), aluminum or steel plate. When the propeller part 61 is formed of metal as described above, the microwave supplied to the waveguide 30 is reflected efficiently.

The motor part 62 is installed on an upper face of the rotating reflection part 37 (upper face in FIG. 4). Further, a rotation output shaft 63 of the motor part 62 is extended in a perpendicular direction with respect to the carrying direction "D2" of the microwave and the rotation output shaft 63 is connected with the propeller part 61. Therefore, when the motor part 62 is rotationally driven, the propeller part 61 is rotated in the inside of the rotating reflection part 37 with the vertically extended shaft with respect to the carrying direction "D2" of the microwave as a center axis.

The propeller member 60 is disposed so that a separated distance "A" between the center axis of the rotation output shaft 63 and the terminal end of the rotating reflection part 37 is set to be "(n/2)λg". The "n" is an integer of 1 or more.

The short-circuiting plate 90 is provided on a terminal end face of the rotating reflection part 37, in other words, on a face of the most distal end part in the carrying direction "D2" of the microwave in the waveguide 30. The short-circuiting plate 90 is a well-known short-circuiting plate, which terminates the microwave that is carried to the rotating reflection part 37 but is not reflected by the propeller part 61.

As shown in FIGS. 3 and 4, the ventilation part 38 is disposed at the starting end part of the waveguide 30 and the ventilation part 39 is disposed at the terminal end part of the waveguide 30. Specifically, the ventilation part 38 is disposed between the matching part 36 and the waveguide main body 31, and the ventilation part 39 is disposed between the waveguide main body 32 and the rotating reflection part 37. The ventilation parts 38 and 39 are provided for ventilating the entire inside of the waveguide 30. However, the ventilation part 38 especially ventilates gas which remains in the inside of the waveguide main body 31 and the ventilation part 39 especially ventilates gas which remains in the inside of the waveguide main body 32. The ventilation parts 38 and 39 are respectively attached with ventilation members 70 and 80 for sucking and discharging gas.

Figure 7:
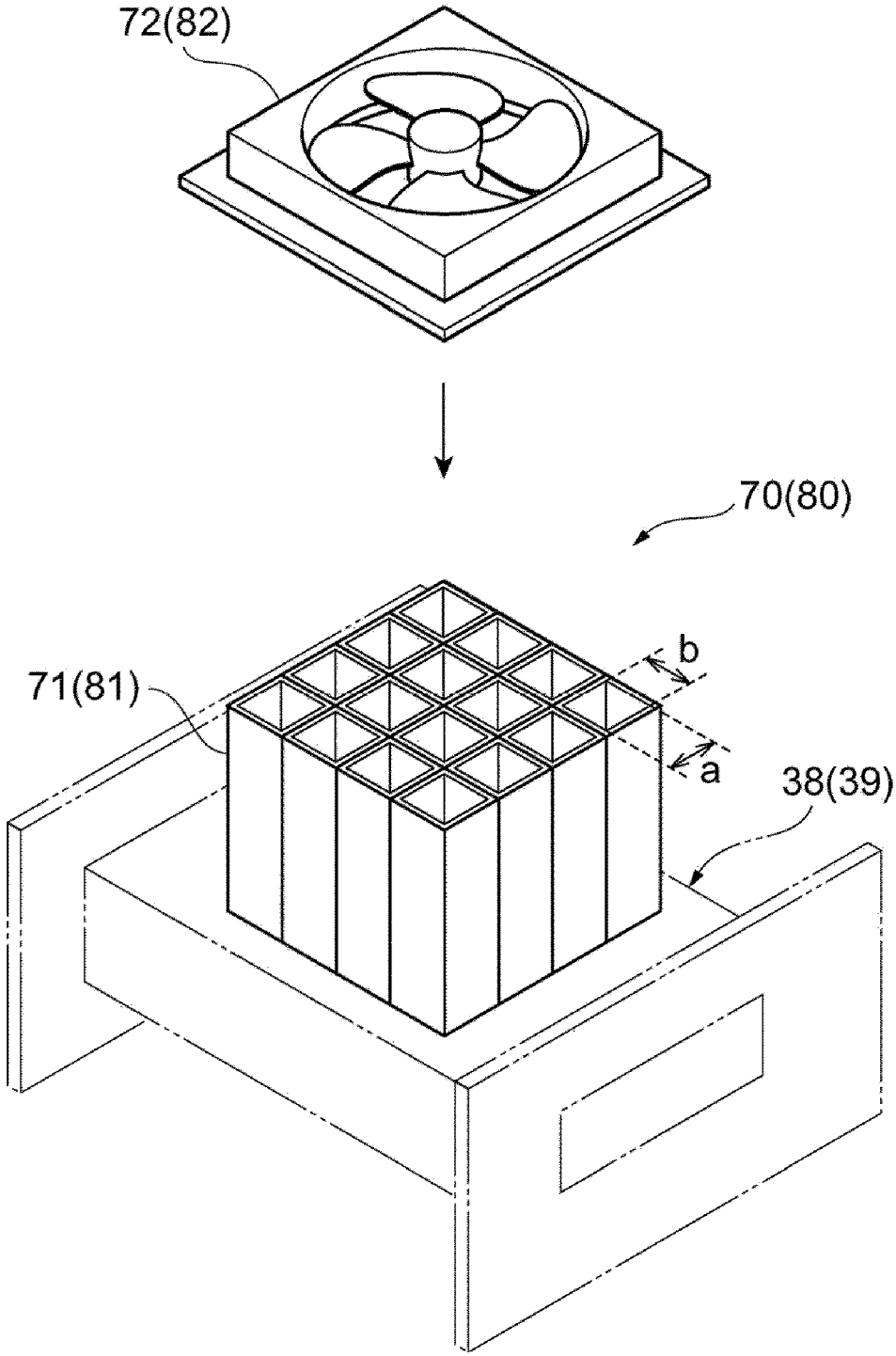
FIG. 7 is an exploded perspective view showing a ventilation member.

FIG. 7 is an exploded perspective view showing the ventilation member. As shown in FIG. 7, the ventilation members 70 and 80 are respectively provided with ventiducts 71 and 81 communicated with the inside of the ventilation parts 38 and 39 and fans 72 and 82 which are attached to the ventiducts 71 and 81.

The ventiducts 71 and 81 are structured by bundling a plurality of square pipes. When a longitudinal width of a rectangular cross section of the respective square pipes is "a" and a lateral width of the rectangular cross section of the respective square pipes is "b", the ventiducts 71 and 81 are formed so that the longitudinal width "a" and the lateral width "b" are set to be equal to or shorter than the cutoff wavelength of the microwave which is supplied to the inside of the waveguide 30. Specifically, the longitudinal width "a" and the lateral width "b" are set to satisfy the following expression with respect to the transmission mode "$TMm_n$" in the inside of the waveguide 30:

$$\lambda g > 1/\{(m/2a)^2+(n/2b)^2\}1/^2$$

The fans 72 and 82 are attached to sucking and discharging ports of the ventiducts 71 and 81 which are located at tip ends of the ventiducts 71 and 81, and the fans 72 and 82 perform a sucking and discharging operation of the inside of the waveguide 30. The fans 72 and 82 are provided with built-in heaters not shown and hot air can be sent into the waveguide 30 through the fans 72 and 82 by means of that an electric current is supplied to the heaters. The heater is structured of, for example, a plurality of heating wires, and temperature of the hot air may be changed by changing the number of heating wires to be energized. In this case, the heater is preferably set to be that hot air is sent into the waveguide 30 by the fans 72 and 82 so that temperature in the inside of the waveguide 30 is in a range from 40° C. to 60° C. Further, a sucking mode and a discharging mode of the fans 72 and 82 are changable and, for example, the sucking mode and the discharging mode can be changed by switching a voltage inputted into the fans 72 and 82 in positive or negative.

Next, an operation of the inkjet printer 1 in accordance with an embodiment of the present invention will be described below.

First, the feeding rollers 21 are rotated to feed a medium "M" onto the platen 22. Next, ink is ejected from the inkjet head 23 onto the medium "M" which is placed on the platen 22. In this manner, images, characters or the like are printed on the medium "M".

After that, the medium "M" onto which the ink is ejected is inserted into the waveguide main body 31 from the insertion opening 41 and the medium "M" having passed through the waveguide main body 31 is inserted into the waveguide main body 32 from the insertion opening 42 and, while driving the fans 72 and 82, microwave is supplied to the inside of the waveguide 30 from the magnetron 43.

In accordance with an embodiment of the present invention, for example, in a case that a feeding speed of the medium "M" by the feeding rollers 21 is 12 cm/minute and an irradiation width of the microwave in the waveguide main body 31 and the waveguide main body 32 is 12 cm (6 cm×2), when the microwave whose irradiation energy is 500 W is irradiated to the medium "M" as the microwave supplied to the waveguide 30 from the magnetron 43, the microwave of "500 W×60 second=30000 J" is irradiated to the medium "M".

Next, an operation of the microwave which is supplied from the magnetron 43 will be described below.

The microwave which is to be supplied to the waveguide 30 from the magnetron 43 is carried to the waveguide main body 31 after a reflecting electric power is firstly reduced by the microwave matcher 45 in the matching part 36. A part of the microwave carried into the waveguide main body 31 is absorbed by the ink ejected onto the medium "M" which is inserted from the insertion opening 41 to dry the ink. The microwave which is not used for drying the ink in the waveguide main body 31 is passed through the waveguide main body 31 and, after being bent by the bent part 33, the microwave is carried to the waveguide main body 32. A part of the microwave carried into the waveguide main body 32 is, similarly to the waveguide main body 31, absorbed by the ink ejected onto the medium "M" which is inserted from the insertion opening 42 to dry the ink.

After that, the microwave which is not used for drying the ink in the waveguide main body 32 is passed through the waveguide main body 32 to be carried to the rotating reflection part 37. The microwave which is carried to the rotating reflection part 37 is subjected to reflection-termination processing by the propeller part 61 of the propeller member 60.

Next, the reflection-termination processing of the microwave by the propeller member 60 will be described in detail below.

While the microwave is supplied from the magnetron 43, the motor part 62 of the propeller member 60 is rotationally driven and the propeller part 61 is rotated in the inside of the rotating reflection part 37. Therefore, a part of the microwave which is carried to the rotating reflection part 37 is reflected by the reflection face 611 of the propeller part 61. Since the propeller part 61 is rotated by rotational driving of the motor part 62, the microwave is reflected in a direction of the reflection face 611 which is appropriately varied with a rotation angle of the propeller part 61.

Figure 8:
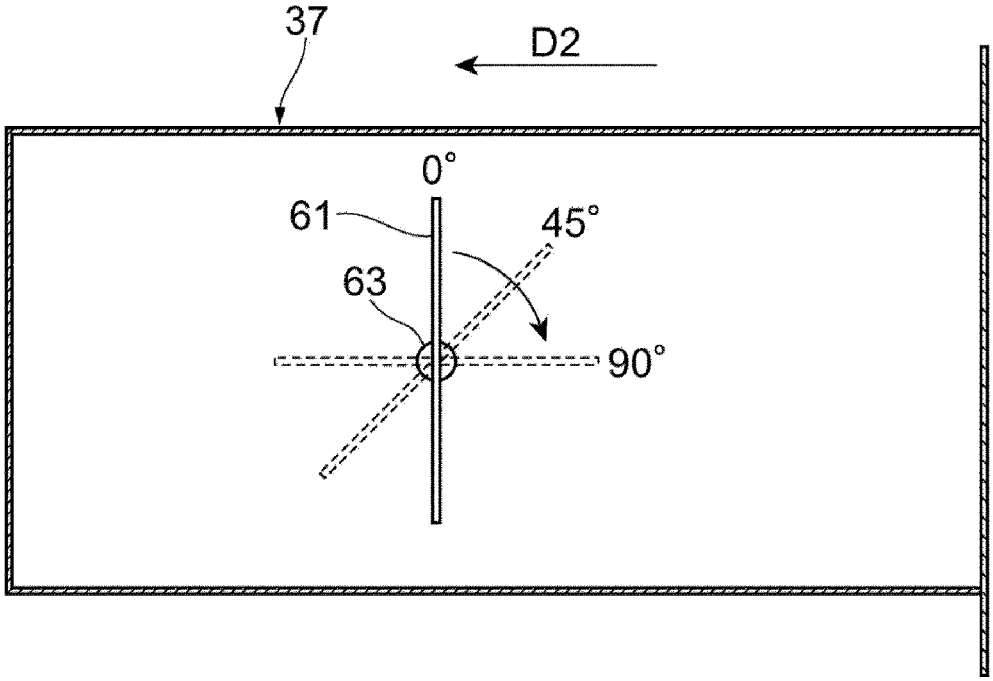
FIG. 8 is a view showing rotation angles of a propeller part in the rotating reflection part.
Figure 9A:
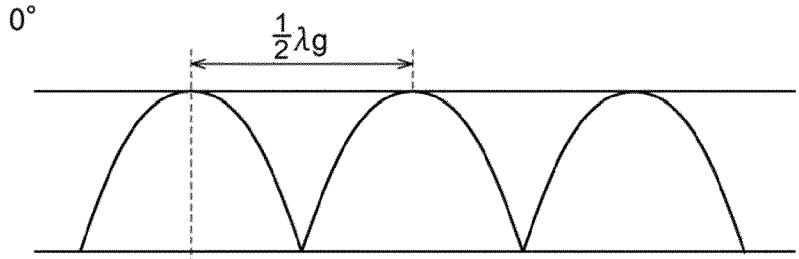
FIGS. 9A, 9B, and 9C are views showing states of standing waves at respective rotation angles of the propeller part shown in FIG. 8.
Figure 9B:
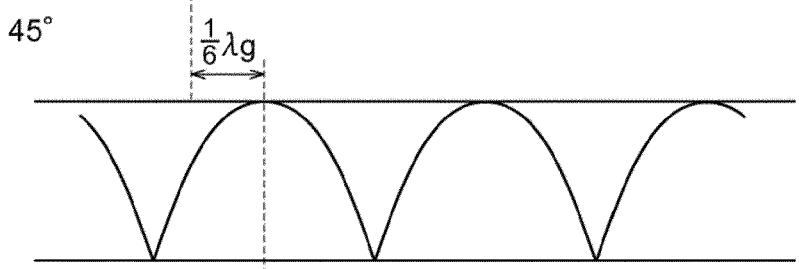
Figure 9C:
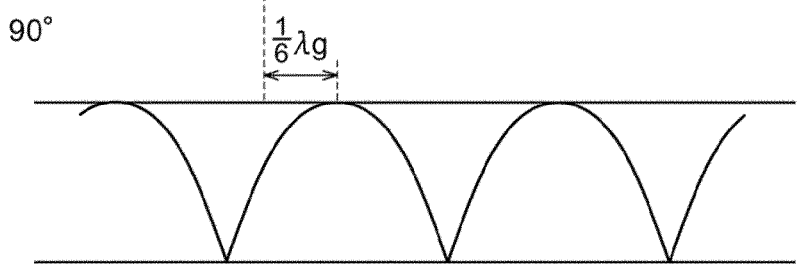

FIG. 8 is a view showing rotation angles of the propeller part in the rotating reflection part and FIGS. 9A, 9B and 9C are views showing states of standing waves at respective rotation angles of the propeller part shown in FIG. 8. In this embodiment, a rotation angle of the propeller part 61 which is directed to a perpendicular direction with respect to the carrying direction "D2" of the microwave is set to be 0° (zero degree) and, when viewed from the upper side, an angle in a clockwise rotation becomes larger in the positive direction. As shown in FIG. 8 and FIGS. 9A, 9B and 9C, when the rotation angle of the propeller part 61 is 0° (zero degree), a standing wave shown in FIG. 9A is generated. When the rotation angle of the propeller part 61 is varied to 45°, a standing wave is generated whose phase is shifted by (⅙)λg with respect to the standing wave whose rotation angle of the propeller part 61 is 0° as shown in FIG. 9B. Further, when the rotation angle of the propeller part 61 is varied to 90°, as shown in FIG. 9C, a standing wave is generated whose phase is shifted by (⅓)λg with respect to the standing wave whose rotation angle of the propeller part 61 is 0° and whose phase is shifted by (⅙)λg with respect to the standing wave whose rotation angle of the propeller part 61 is 45°.

As described above, the reflection direction of the microwave which is reflected by the propeller part 61 is varied by the rotation of the propeller part 61. Therefore, generation of a standing wave by the microwave directing to the rotating reflection part 37 from the electromagnetic wave supply part 34 and by the microwave reflected by the propeller part 61 is restrained and the peak position of the standing wave is varied in the inside of the waveguide 30. As described above, since the peak position of the standing wave is varied, uneven drying of the ink in the longitudinal direction of the waveguide main bodies 31 and 32 is restrained.

The microwave which has been subjected to the reflection-termination processing in the rotating reflection part 37 as described above is returned to the waveguide main body 32 again by the rotating reflection part 37. A part of the microwave carried into the waveguide main body 32 is absorbed by the ink ejected onto the medium "M" which is inserted from the insertion opening 42 to dry the ink. The microwave which is not used for drying the ink in the waveguide main body 32 is passed through the waveguide main body 32 and, after being bent by the bent part 33, the microwave is carried to the waveguide main body 31. A part of the microwave carried into the waveguide main body 31 is absorbed by the ink ejected onto the medium "M" which is inserted from the insertion opening 41 to dry the ink. After that, the microwave which is also not used for drying the ink in the waveguide main body 31 is passed through the waveguide main body 31 to be carried to the propagation preventing part 35. The microwave having been carried to the propagation preventing part 35 is prevented from propagation to the electromagnetic wave supply part 34 by the isolator 44 which is attached to the propagation preventing part 35.

Next, ventilating operation of the fans 72 and 82 will be described below.

As described above, when the microwave is irradiated onto the medium "M" which is inserted from the insertion openings 41 and 42 of the waveguide main bodies 31 and 32, the ink ejected onto the medium "M" is dried while the solvent is evaporated to generate solvent vapor. Therefore, the fans 72 and 82 are driven to discharge the solvent vapor remained in the inside of the waveguide 30 to the outside to promote drying of the ink.

When the fans 72 and 82 are driven in the suction direction, the outside air is sent into the waveguide 30 through the fans 72 and 82. Therefore, the gas remained in the inside of the waveguide 30 is pushed out from the waveguide 30 through the insertion openings 41 and 42 which are formed in the waveguide main bodies 31 and 32. According to the above-mentioned ventilating operation of the fans 72 and 82, the solvent vapor of the ink which is vaporized by irradiation of the microwave in the inside of the waveguide 30 is discharged to the outside of the waveguide 30 through the insertion openings 41 and 42 and thus a dried state in the waveguide 30 is maintained and drying of the ink is promoted. In this case, an electric current is supplied to the built-in heaters of the fans 72 and 82 and hot air having a predetermined temperature is sent into the waveguide from the fans 72 and 82 so that the inside temperature of the waveguide 30 becomes in a range of 40° C. to 60° C. As a result, drying of the ink is further promoted by the hot air that is sent into the waveguide 30.

On the other hand, when a discharging operation is performed by the fans 72 and 82, the outside air is sucked into the waveguide 30 through the insertion openings 41 and 42 which are formed in the waveguide main bodies 31 and 32 and the gas in the inside of the waveguide 30 is discharged to the outside of the waveguide 30 through the fans 72 and 82. When the ventilating operation of the fans 72 and 82 is performed as described above, the solvent vapor of the ink which is vaporized by irradiation of the microwave in the inside of the waveguide 30 is discharged to the outside of the waveguide 30 by the fans 72 and 82 and thus a dried state in the inside of the waveguide 30 is maintained and drying of the ink is promoted.

EXAMPLES

Next, examples of the inkjet printer 1 in accordance with the embodiment of the present invention will be described below. In Examples 1 through 6, "JV33" made by MIMAKI ENGINEERING CO., LTD is used as the inkjet printer 1.

Example 1

In Example 1, experiments and observations are performed with regard to a blocking state and a rear gore state of a medium "M" when the inkjet printer 1 is used and ink has been dried. In this specification, the "blocking" means a phenomenon that a medium of vinyl chloride and a protection sheet for the medium structuring the medium "M" are fixed to each other and the "rear gore" means a phenomenon that the protection sheet is distorted to cause the medium to be curved (curled).

Experiment conditions are as follows.

(1) Used ink: Eco-HS1 ink (solvent ink)
(2) Medium: White vinyl chloride glossy (middle term)
(3) Printing condition: 540×1080 dpi-6P1L-Bi 300% Solid printing
(4) Winding torque for medium: Maximum
(5) Pre-heater: 35° C.
(6) Print heater: 35° C.
(7) Drying conditions:

Example 1-1

Microwave irradiation by magnetron
Electric power of magnetron: 500 W
Blowing by fan
Quantity of blowing air: Strong blowing mode (4.80 $m^3$/min)
Air temperature: 46 to 47° C.
(inside temperature of the waveguide 30)

Example 1-2

Microwave irradiation by magnetron
Electric power of magnetron: 500 W
Blowing air by fan
Quantity of blowing air: Strong blowing mode (4.80 $m^3$/min)
Mild blowing mode (2.37 $m^3$/min)
Air temperature: Hot air (Heater ON: 46 to 47° C.)
Un-hot air (Heater OFF: Room temperature)

Example 1-3

Microwave irradiation by magnetron
Electric power of magnetron: 600 W
Blowing air by fan
Quantity of blowing air: Strong blowing mode (4.80 $m^3$/min)
Mild blowing mode (2.37 $m^3$/min)
Air temperature: Hot air (Heater ON: 46 to 47° C.)
Un-hot air (Heater OFF: Room temperature)

(8) Termination:
Reflection termination by the propeller member (4.5V)

The pre-heater is a pre-heater which is used in a conventional inkjet printer and is a heater for setting a medium "M" at a predetermined temperature in a preceding stage before the medium "M" is carried to the platen 22. The print heater is a print heater which is used in a conventional inkjet printer and is a heater for setting the medium "M" placed on the platen 22 at a predetermined temperature. Further, a commercially available drier is used as the fan and the air temperature of the air which is sent into the waveguide 30 by the fan is an inside temperature which is measured in the inside of the waveguide 30 into which the outside air heated by the heater is sent into the waveguide 30 by the fan.

Experiment results of Example 1-1 are shown in Table 1, experiment results of Example 1-2 are shown in Table 2, and experiment results of Example 1-3 are shown in Table 3. In Tables 1 to 3, the double circle indicates "good," the single circle indicates "fair," and the triangle indicates "mediocre."

TABLE 1

| Blowing Quantity: Strong Blowing | | Un-hot Air | |
|---|---|---|---|
| First Fan | Second Fan | Blocking | Rear Gore |
| Sending Air | Discharging Air | Δ | ◎ |
| Sending Air | Sending Air | Δ | ◎ |

TABLE 2

| Blowing Quantity: Mild Blowing | | Un-hot Air | | Hot Air | |
|---|---|---|---|---|---|
| First Fan | Second Fan | Blocking | Rear Gore | Blocking | Rear Gore |
| Sending Air | Discharging Air | — | — | ○+ | ◎ |
| Sending Air | Sending Air | ○ | ◎ | ○+ | ◎ |

TABLE 3

| Blowing Quantity: Mild Blowing | | Un-hot Air | | Hot Air | |
|---|---|---|---|---|---|
| First Fan | Second Fan | Blocking | Rear Gore | Blocking | Rear Gore |
| Sending Air | Discharging Air | Δ | Δ | Δ | Δ |
| Sending Air | Sending Air | Δ | ○ | ◎ | ○ |

As shown in Table 1, when the microwave is irradiated onto the medium "M" and ventilation is performed in the inside of the waveguide 30, occurrence of the blocking and the rear gore is restrained. Further, when hot air is sent by the fans 72 and 82, occurrence of the blocking and the rear gore is restrained in comparison with a case that un-hot air is sent.

Example 2

In Example 2, experiments and observations are performed with regard to an occurrence state of the blocking of the medium "M" when the inkjet printer 1 is used and ink has been dried. In Example 2, an electric power generating the microwave from the magnetron 43 is varied to 0 W, 300 W, 400 W, 500 W and 600 W, and the fans 72 and 82 are operated in a strong blowing mode (air quantity: 4.80 $m^3$/min) and a mild blowing mode (air quantity: 2.37 $m^3$/min), and hot air of 46° C. to 47° C. (inside temperature of the waveguide 30) is sent into the waveguide 30 for drying. Further, as Comparison example 2 with respect to Example 2, in a post-process of ejecting the ink onto the medium "M", the medium "M" is passed through an after-heater (50° C.) having a built-in heating wire without operating the magnetron 43 and the fans 72 and 82 and then the medium "M" is left to stand for one day. Further, Reference example 2 for comparing with Example 2 is printed by a conventional inkjet printer.

Experiment conditions are as follows.

(1) Used ink: Eco-HS1 ink (solvent ink)
(2) Medium: White polyvinyl chloride glossy (middle term)
(3) Printing condition: 540×1080 dpi-6P1L-Bi 300% Solid printing
(4) Winding torque for medium: Maximum
(5) Pre-heater: 35° C.
(6) Print heater: 35° C.
(7) Rotation speed of the propeller part: 15.6 rpm
(8) Drying conditions:

Example 2-1

Microwave irradiation by magnetron
Electric power of magnetron: 600 W
Blowing by fan
Quantity of blowing air: Mild blowing mode (2.37 $m^3$/min)
Air temperature: Hot air (Heater ON: 46 to 47° C.)

Example 2-2

Microwave irradiation by magnetron
Electric power of magnetron: 500 W
Blowing by fan
Quantity of blowing air: Mild blowing mode (2.37 $m^3$/min)
Air temperature: Hot air (Heater ON: 46 to 47° C.)

Example 2-3

Microwave irradiation by magnetron
Electric power of magnetron: 400 W
Blowing by fan
Quantity of blowing air: Mild blowing mode (2.37 $m^3$/min)
Air temperature: Hot air (Heater ON: 46 to 47° C.)

Example 2-4

Microwave irradiation by magnetron
Electric power of magnetron: 300 W
Blowing by fan
Quantity of blowing air: Mild blowing mode (2.37 $m^3$/min)
Air temperature: Hot air (Heater ON: 46 to 47° C.)

Example 2-5

Microwave irradiation by magnetron
Electric power of magnetron: 0 W
Blowing by fan
Quantity of blowing air: Mild blowing mode (2.37 $m^3$/min)
Air temperature: Hot air (Heater ON: 46 to 47° C.)

Comparison Example 2

After-heater+natural drying (left to stand for 24 hours)
Temperature of after-heater: 50° C.
(9) Termination:
Reflection termination by the propeller member (4.5V)

Figure 10:
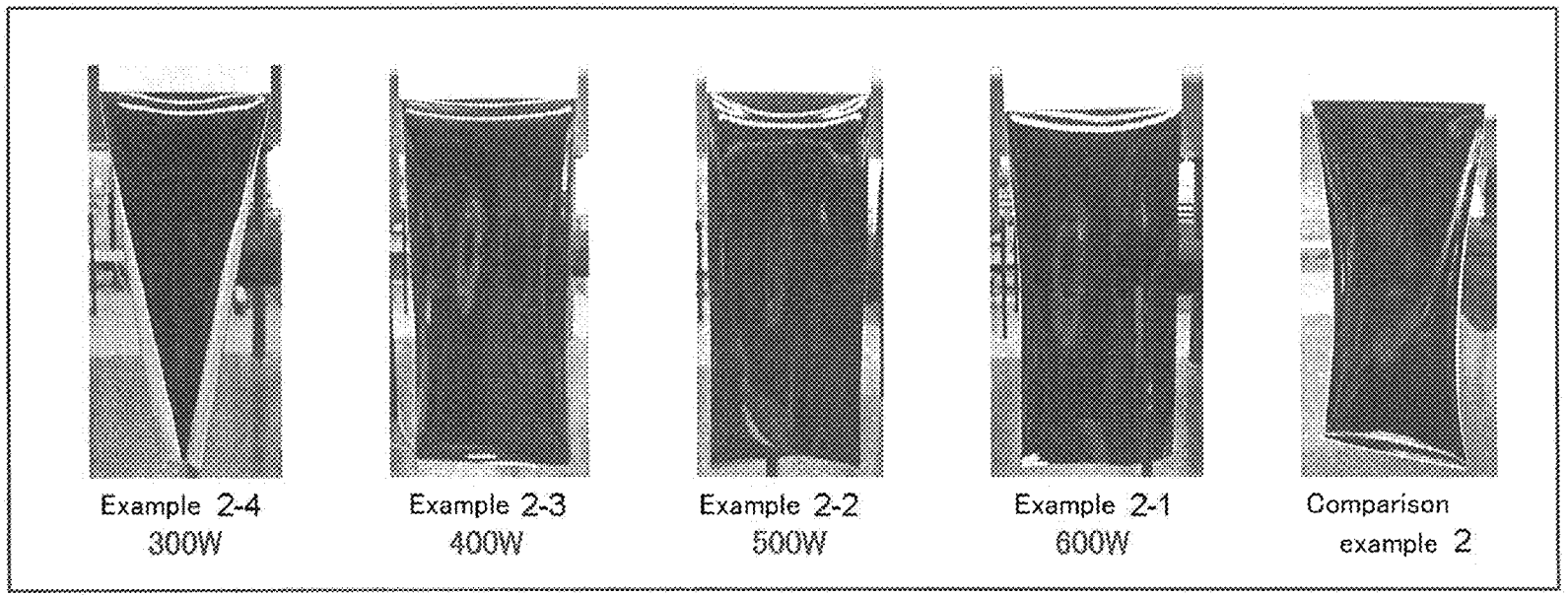
FIG. 10 is a view showing photographs of dried media which are image-picked up in Example 2.

Photographs of dried media which are image-picked up according to the above-mentioned experiment methods are shown in FIG. 10. Further, occurrences of blocking in Examples 2-1 through 2-5 and Comparison example 2 are shown by scores, i.e., "5" (no occurrence), "4" (little occurrence), "3" (little occurrence in whole), "2" (much occurrence in whole) and "1" (occurrence of offset) in the lowest order of the occurrence.

Figure 11:
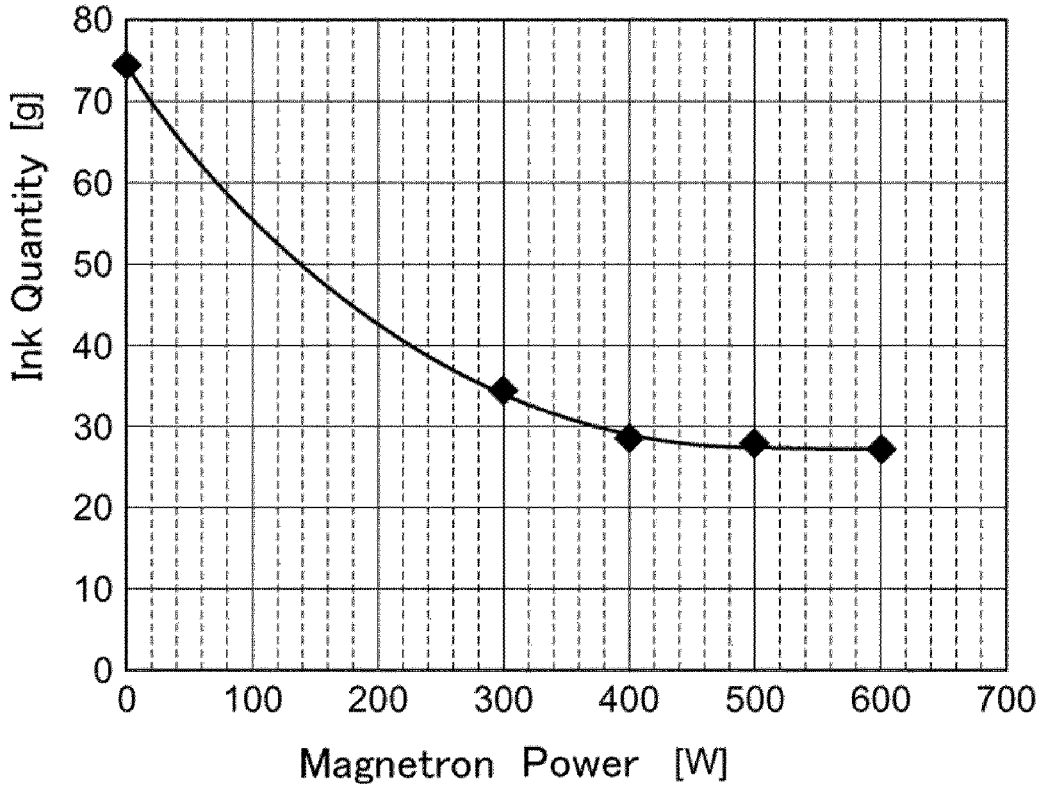
FIG. 11 is a graph showing experimental results in Table 4.

Experiment results of Example 2 are shown in Table 4 and FIG. 11 is a graph showing the experimental results of the Table 4.

TABLE 4

| | Power [W] | Medium Mass [g] | Blocking | Ink Quantity after Dried [g] |
|---|---|---|---|---|
| Example 2-1 | 600 | 417.66 | 5 | 27.33 |
| Example 2-2 | 500 | 418.47 | 4 | 28.14 |
| Example 2-3 | 400 | 418.81 | 2 | 28.48 |
| Example 2-4 | 300 | 424.80 | 2 | 34.47 |
| Example 2-5 | 0 | 464.95 | 1 | 74.62 |
| Comparison Example | | 410.15 | 5 | 19.85 |

As shown in Table 4 and FIG. 11, in Example 2, when the electric power of the magnetron 43 is set to be equal to or larger than 400 W to irradiate the microwave and hot air is sent into the waveguide 30 by the fans 72 and 82, an ink quantity after having been dried is reduced sufficiently. Further, in Example 2, when the electric power of the magnetron 43 is set to be 600 W or more, the occurrence of blocking is suppressed in an equivalent level to Comparison example 2.

Example 3

In Example 3, experiments and observations are performed with regard to eraser rubbing resistance, water rubbing resistance and alcohol rubbing resistance when the inkjet printer 1 is used and ink has been dried. In Example 3, the electric power for generating the microwave from the magnetron 43 is fixed at 500 W and the fans 72 and 82 are set in a mild blowing mode (air quantity: 2.37 $m^3$/min) and hot air of 46° C. to 47° C. (inside temperature of the waveguide 30) is sent into the waveguide 30 for drying. Further, Reference example 3 for comparing with Example 3 is printed by a conventional inkjet printer.

Experiment conditions are as follows.

(1) Used ink: Eco-HS1 ink (solvent ink)
(2) Medium: White polyvinyl chloride glossy (middle term)
(3) Printing condition: 540×1080 dpi-6P1L-Bi 100%, 20% Solid printing
(4) Winding torque for medium: Maximum
(5) Pre-heater: 35° C.
(6) Print heater: 35° C.
(7) Print density, Drying conditions:

Example 3

Microwave irradiation by magnetron
Electric power of magnetron: 500 W
Blowing by fan
Quantity of blowing air: Mild blowing mode (2.37 $m^3$/min)
Air temperature: Hot air (Heater ON: 46 to 47° C.)

Comparison Example 3

After-heater+natural drying (left to stand for 24 hours)
Temperature of after-heater: 50° C.
(8) Termination:
Reflection termination by the propeller member (4.5V)

An evaluation method for an eraser rubbing resistance is as follows. In other words, an eraser having a cross section of "7ϕ" is reciprocated by 10 times on the printed face while applying a load of 1.0 kgf and, after that, a blurring degree of the ink is evaluated. The evaluation is represented with a numerical value as a score, i.e., "10" (rubbing resistance is the highest) through "1" (rubbing resistance is the lowest) in a sequential order from the highest rubbing resistance.

An evaluation method for a water rubbing resistance is as follows. In other words, ion-exchange water is impregnated into a cotton swab and the cotton swab is reciprocated by 100 times on the printed face and, after that, color migration of the ink to the cotton swab and peeling of the printed face are confirmed by visual inspection. When color migration to the cotton swab and peeling of the printed face are confirmed, the evaluation is represented as "×" and, when color migration to the cotton swab and peeling of the printed face are not confirmed, the evaluation is represented as "○".

An evaluation method for an alcohol rubbing resistance is as follows. In other words, alcohol water solutions in a range of 0 to 100% are impregnated into cotton swabs at a 10% interval and each of the cotton swabs is reciprocated by 10 times and, after that, variation of the printed face is confirmed by visual inspection. The value of the alcohol concentration at which variation of the printed face is not confirmed is represented as a score.

"K", "M", "C", "Y", "Lm" and "Lc" indicate colors of the respective inks. "K" is Black, "M" is Magenta, "C" is Cyan, "Y" is Yellow, "Lm" is Light magenta and "Lc" is Light cyan.

Figure 12A:
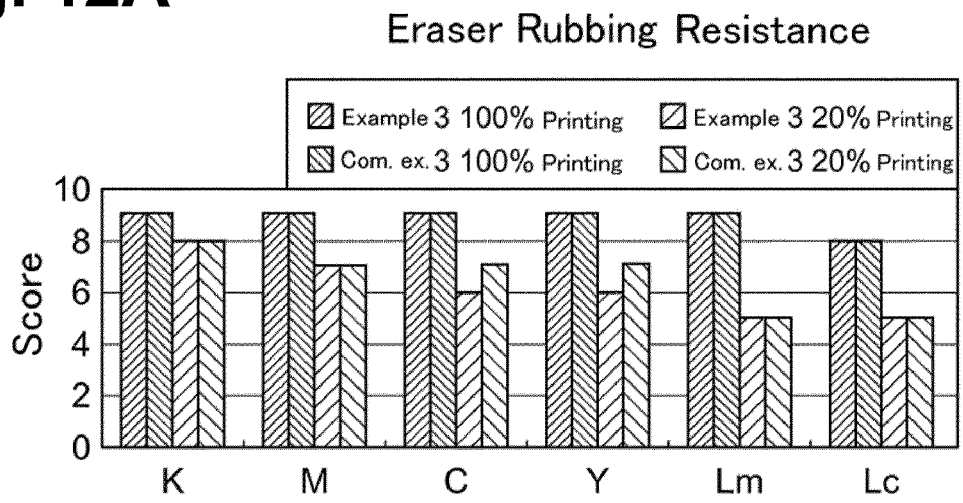
FIGS. 12A and 12B are graphs showing experimental results in Example 3, with FIG. 12A showing comparison of Example 3 with Comparison example 3 relating to eraser rubbing resistance and FIG. 12B showing comparison of Example 3 with Comparison example 3 relating to alcohol rubbing resistance.
Figure 12B:
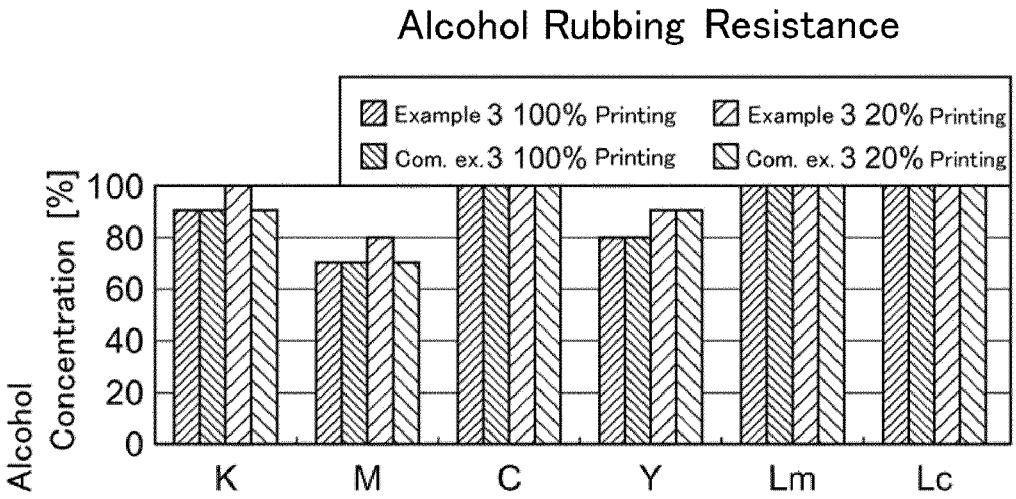

Experiment results of Example 3 are shown in Table 5 and experiment results of Comparison example 3 are shown in Table 6. Further, comparison of Example 3 with Comparison example 3 relating to the eraser rubbing resistance is shown in FIG. 12A and comparison of Example 3 with Comparison example 3 relating to the alcohol rubbing resistance is shown in FIG. 12B. In Tables 5 and 6, the single circle indicates "fair."

TABLE 5

| | | Ink | | | | | |
|---|---|---|---|---|---|---|---|
| | Color | K | M | C | Y | Lm | Lc |
| Eraser Rubbing Resistance | 100% Printing | 9 | 9 | 9 | 9 | 9 | 8 |
| | 20% Printing | 8 | 7 | 6 | 6 | 5 | 5 |
| Water Rubbing Resistance | Color Migration to Cotton Swab | ○ | ○ | ○ | ○ | ○ | ○ |
| | Peeling of Printed Face | ○ | ○ | ○ | ○ | ○ | ○ |
| Alcohol Rubbing Resistance | 100% Printing | 90% | 70% | 100% | 80% | 100% | 100% |
| | 20% Printing | 100% | 80% | 100% | 90% | 100% | 100% |

TABLE 6

| | | Ink | | | | | |
|---|---|---|---|---|---|---|---|
| | Color | K | M | C | Y | Lm | Lc |
| Eraser Rubbing Resistance | 100% Printing | 9 | 9 | 9 | 9 | 9 | 8 |
| | 20% Printing | 8 | 7 | 7 | 7 | 5 | 5 |
| Water Rubbing Resistance | Color Migration to Cotton Swab | ○ | ○ | ○ | ○ | ○ | ○ |
| | Peeling of Printed Face | ○ | ○ | ○ | ○ | ○ | ○ |
| Alcohol Rubbing Resistance | 100% Printing | 90% | 70% | 100% | 80% | 100% | 100% |
| | 20% Printing | 90% | 70% | 100% | 90% | 100% | 100% |

As shown in Tables 5 and 6 and FIGS. 12A and 12B, Example 3 is provided with rubbing resistances in equivalent levels to Comparison example 3 although there are some differences between them.

Example 4

In Example 4, experiments and observations are performed with regard to shrinkage of the medium "M" which is obtained by means of that the inkjet printer 1 is used and ink has been dried and, after a predetermined time period has passed, the medium "M" is cut. In Example 4, the medium "M" is cut and used after one hour, three hours, six hours and 24 hours have passed after the ink was ejected onto the medium "M". Further, Reference example 4 for comparing with Example 4 is printed by a conventional inkjet printer.

Experiment conditions are as follows.

(1) Used ink: Eco-HS1 ink (solvent ink)

(2) Medium: White polyvinyl chloride glossy (middle term)

(3) Printing condition: 540×1080 dpi-6P1L-Bi

300% density: "C", "M" and "Y" are respectively printed in a 100% density.

200% density: "M" and "C" are respectively printed in a 100% density.

(4) Winding torque for medium: Maximum (5) Pre-heater: 35° C.

(6) Print heater: 35° C.

(7) Drying conditions:

Example 4

Microwave irradiation by magnetron

Electric power of magnetron: 500 W

Blowing by fan

Quantity of blowing air: Mild blowing mode (2.37 $m^3$/min)

Air temperature: Hot air (Heater ON: 46 to 47° C.)

Comparison Example 4

After-heater+natural drying (left to stand for 24 hours)

Temperature of after-heater: 50° C.

(8) Termination:

Reflection termination by the propeller member (4.5V)

Figure 13:
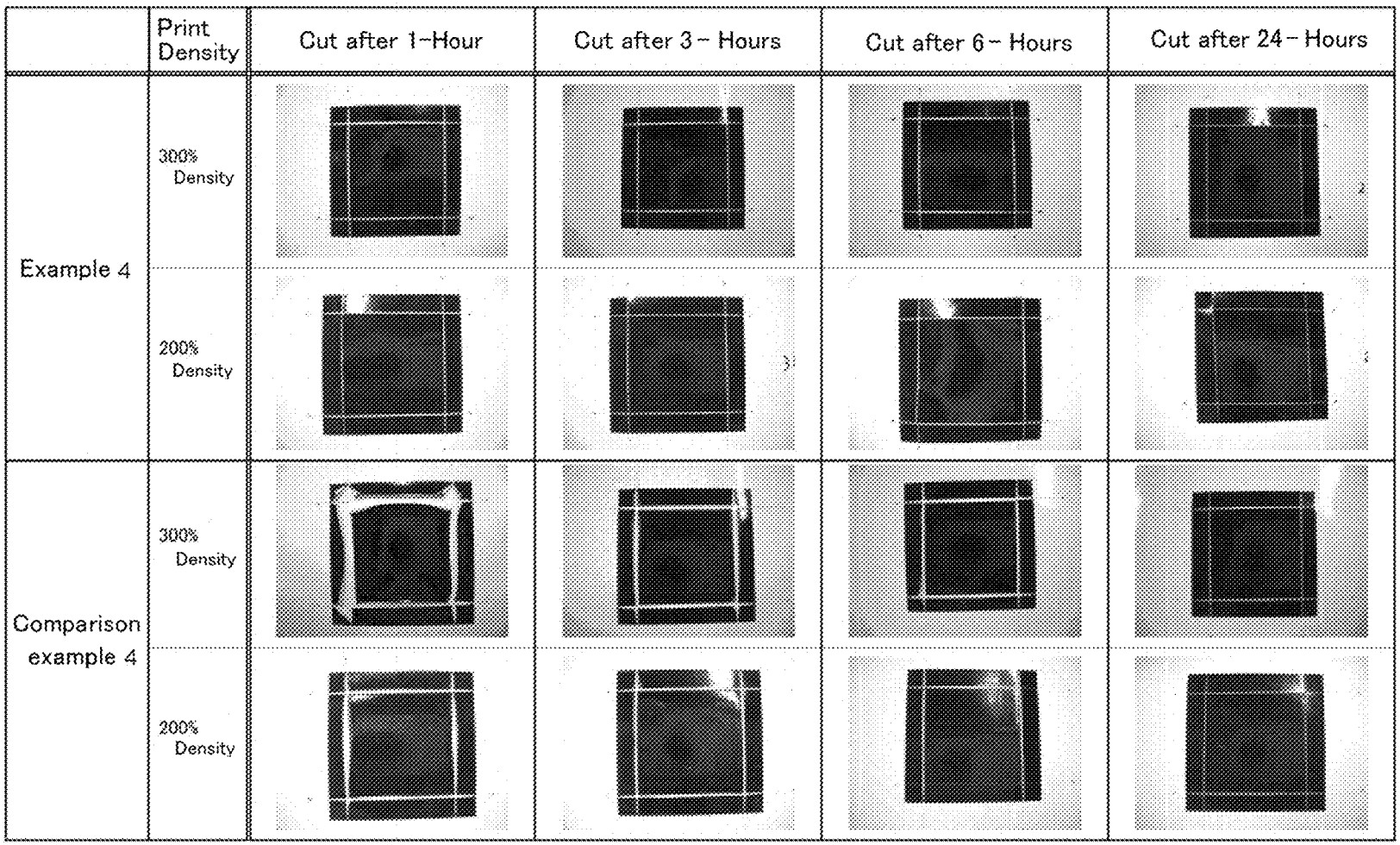
FIG. 13 is a view showing photographs of media which have been dried and cut and image-picked up in Example 4.

Photographs of media which have been dried and cut and image-picked up according to the above-mentioned experiment methods are shown in FIG. 13. As shown in FIG. 13, in Example 4, shrinkage of the medium "M" is hardly confirmed regardless of the print density when one hour has passed after the ink had been ejected. Further, the shrinkage level of the medium "M" which is cut after one hour has passed in Example 4 is substantially equivalent to the shrinkage level which is cut after 24 hours have passed in Comparison example 4. Therefore, in Example 4, the drying speed of the ink is faster than that in Comparison example 4 and thus the shrinkage of the medium "M" is suppressed in an extremely short time period.

Example 5

In Example 5, hue change is observed when the inkjet printer 1 is used and ink has been dried. In Example 5, respective inks of "K", "C", "M", "Y", "C"+"Y", "M"+"Y" and "C"+"M" are used and the respective inks are printed with a print density in a range of 10% to 100% at a 10% interval. And, in order to quantify the hue, "L*a*b*" color space is used. The "L*a*b*" color space is defined by CIE (International Commission on Illumination) or in JIS-Z-8729 or the like and color is quantified by numerical values of respective axes of "L*" axis, "a*" axis and "b*" axis. The "L*" represents lightness (density), the plus side of the "a*" represents reddish and its minus side represents greenish, and the plus side of the "b*" represents yellowish and its minus side represents bluish. Further, Reference example 5 for comparing with Example 5 is printed by a conventional inkjet printer.

Experiment conditions are as follows.

(1) Used ink: Eco-HS1 ink (solvent ink)

(2) Medium: White polyvinyl chloride glossy (middle term)

(3) Printing condition: 540×1080 dpi-6P1L-Bi 100% Solid printing (4) Winding torque for medium: Maximum (5) Pre-heater: 35° C.

(6) Print heater: 35° C.

(7) Drying conditions:

Example 5

Microwave irradiation by magnetron

Electric power of magnetron: 600 W

Blowing by fan

Quantity of blowing air: Mild blowing mode (2.37 $m^3$/min)

Air temperature: Hot air (Heater ON: 46 to 47° C.)

Comparison Example 5

After-heater+natural drying (left to stand for 24 hours)

Temperature of after-heater: 50° C.

(8) Termination:

Reflection termination by the propeller member (4.5V)

Figure 14A:
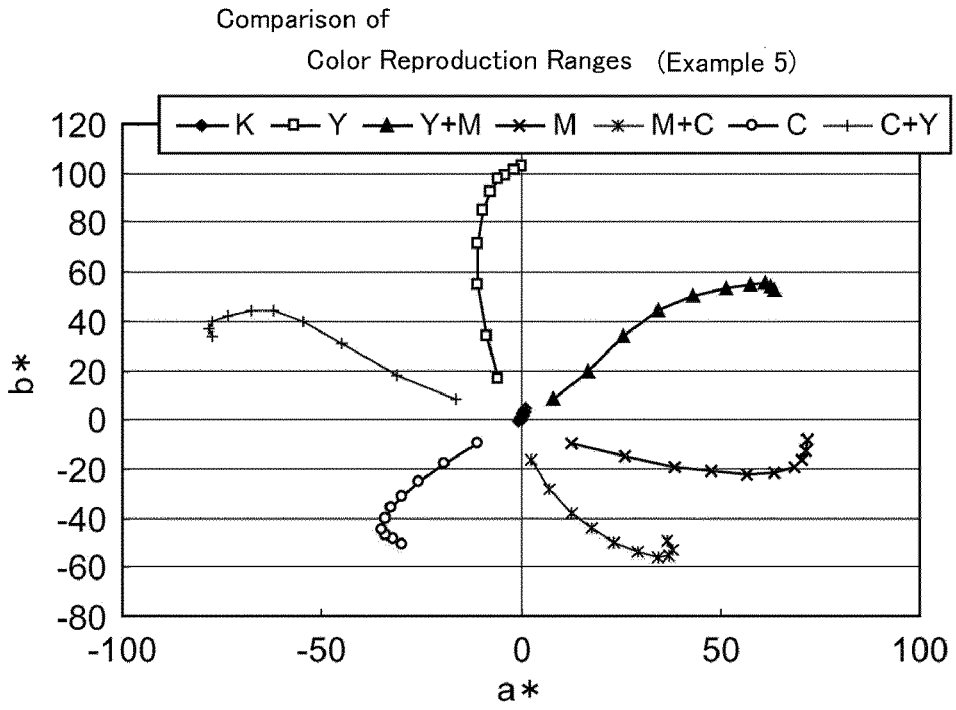
FIGS. 14A and 14B are graphs showing experimental results in Example 5, with FIG. 14A showing color reproduction ranges of respective colors in Example 5 and FIG. 14B showing color reproduction ranges of respective colors in Comparison example 5.
Figure 14B:
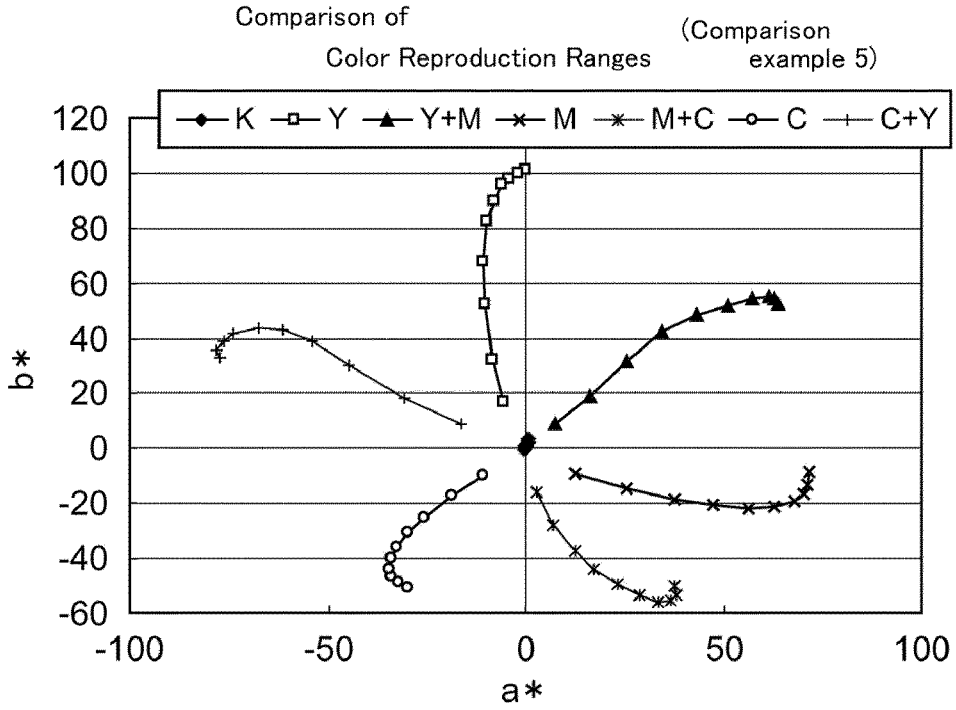
Figure 15:
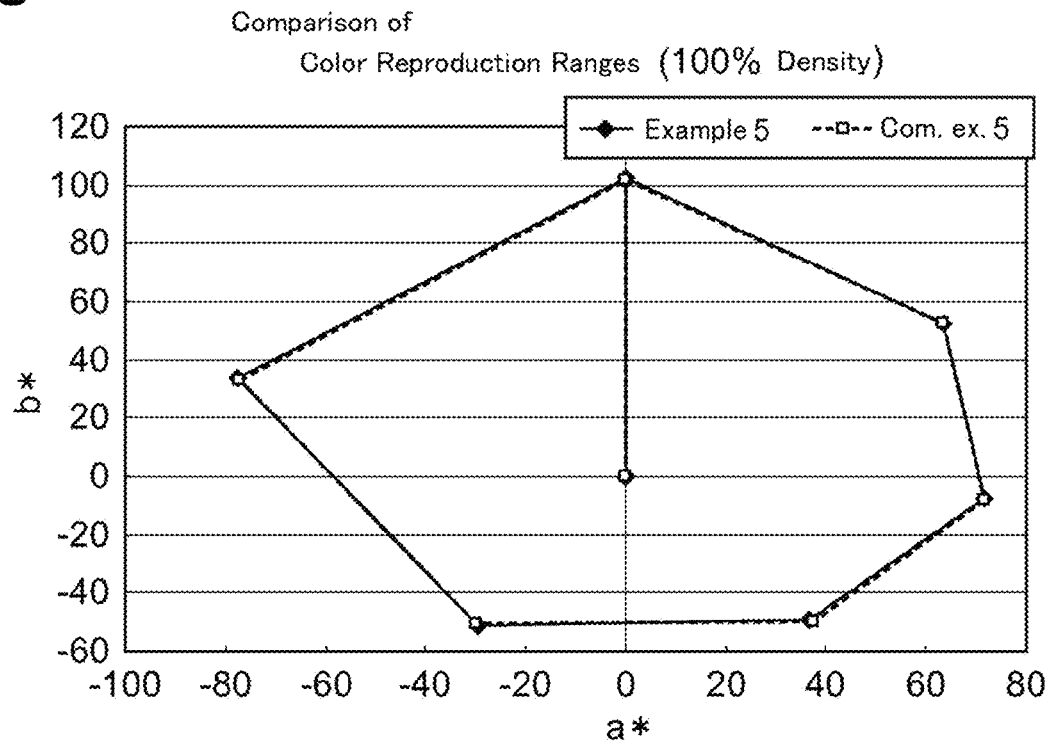
FIG. 15 is a graph showing comparison of experimental results of Example 5 and Comparison example 5.

Experiment results of the color space (L*,a*,b*) in Example 5 are shown in Table 7 and experiment results of the color space (L*,a*,b*) in Comparison example 5 are shown In Table 8. Color reproduction ranges of the respective colors which are expressed with the "a*" and the "b*" in Example 5 are shown in FIG. 14A and color reproduction ranges of the respective colors which are expressed with the "a*" and the "b*" in Comparison example 5 are shown in FIG. 14B. FIG. 15 is a graph showing comparison of Example 5 and Comparison example 5 relating to the "a*" and the "b*" of the respective colors when the print density is 100%. Color difference ΔE*(ab) in the color space of "L*a*b*" is shown in Table 9.

TABLE 7

| Density | | K | Y | Y + M | M | M + C | C | C + Y |
|---|---|---|---|---|---|---|---|---|
| 100% | L* | 0.69 | 80.19 | 36.10 | 37.61 | 9.77 | 49.45 | 36.91 |
| | a* | 0.01 | 0.09 | 63.54 | 71.74 | 36.72 | −29.59 | −77.59 |
| | b* | −0.17 | 102.42 | 52.49 | −7.73 | −49.43 | −51.00 | 33.69 |
| 90% | L* | 0.76 | 81.28 | 38.26 | 40.31 | 12.34 | 52.78 | 40.64 |
| | a* | 0.09 | −1.83 | 62.79 | 71.40 | 37.98 | −32.03 | −78.18 |
| | b* | 0.11 | 100.94 | 53.99 | −12.87 | −53.10 | −48.87 | 36.59 |

TABLE 7-continued

| Density | | K | Y | Y + M | M | M + C | C | C + Y |
|---|---|---|---|---|---|---|---|---|
| 80% | L* | 1.41 | 82.28 | 40.73 | 42.85 | 16.57 | 55.72 | 44.99 |
| | a* | 0.34 | −3.71 | 61.13 | 70.57 | 37.04 | −33.94 | −77.22 |
| | b* | 0.59 | 99.40 | 55.87 | −16.49 | −55.41 | −47.12 | 39.72 |
| 70% | L* | 3.34 | 83.44 | 44.16 | 46.20 | 21.95 | 59.24 | 49.58 |
| | a* | 0.72 | −5.80 | 57.36 | 68.55 | 34.19 | −34.78 | −73.84 |
| | b* | 1.66 | 97.17 | 54.80 | −19.53 | −55.83 | −44.46 | 42.33 |
| 60% | L* | 10.13 | 84.58 | 48.42 | 50.99 | 29.56 | 63.49 | 55.17 |
| | a* | 1.14 | −7.73 | 51.53 | 63.63 | 29.29 | −34.10 | −67.54 |
| | b* | 3.16 | 92.55 | 53.21 | −21.51 | −53.57 | −40.49 | 44.36 |
| 50% | L* | 17.23 | 85.76 | 53.96 | 56.58 | 38.24 | 67.65 | 60.43 |
| | a* | 1.31 | −9.53 | 43.30 | 56.71 | 23.37 | −32.56 | −61.97 |
| | b* | 4.69 | 84.94 | 50.18 | −21.99 | −49.75 | −36.06 | 44.31 |
| 40% | L* | 30.05 | 87.13 | 60.07 | 62.97 | 47.62 | 72.08 | 65.98 |
| | a* | 0.87 | −10.78 | 34.55 | 48.04 | 17.78 | −29.70 | −54.64 |
| | b* | 4.10 | 71.62 | 44.39 | −21.08 | −44.31 | −31.00 | 39.98 |
| 30% | L* | 45.40 | 88.55 | 67.02 | 69.62 | 57.04 | 76.55 | 71.96 |
| | a* | 0.27 | −10.85 | 25.72 | 38.35 | 12.77 | −25.76 | −45.02 |
| | b* | 2.68 | 54.61 | 33.80 | −19.07 | −37.88 | −25.37 | 31.06 |
| 20% | L* | 61.86 | 90.09 | 75.32 | 77.25 | 68.72 | 82.35 | 79.23 |
| | a* | −0.33 | −8.65 | 16.84 | 26.08 | 7.32 | −19.07 | −31.00 |
| | b* | 1.03 | 33.63 | 19.29 | −15.19 | −28.25 | −17.59 | 18.48 |
| 10% | L* | 76.81 | 91.43 | 83.60 | 85.03 | 80.28 | 87.57 | 85.95 |
| | a* | −0.69 | −5.70 | 7.95 | 12.70 | 2.77 | −10.85 | −16.37 |
| | b* | −0.46 | 16.94 | 8.59 | −9.28 | −16.54 | −9.81 | 8.04 |

TABLE 8

| Concen. | | K | Y | Y + M | M | M + C | C | C + Y |
|---|---|---|---|---|---|---|---|---|
| 100% | L* | 0.76 | 80.16 | 36.08 | 37.90 | 9.40 | 49.84 | 37.06 |
| | a* | 0.03 | 0.00 | 63.53 | 71.76 | 37.48 | −29.96 | −77.29 |
| | b* | −0.18 | 101.50 | 52.63 | −8.23 | −49.81 | −50.69 | 32.94 |
| 90% | L* | 0.85 | 81.30 | 38.14 | 40.64 | 12.40 | 53.20 | 40.93 |
| | a* | 0.14 | −1.98 | 62.94 | 71.09 | 37.94 | −32.22 | −78.19 |
| | b* | 0.02 | 99.86 | 54.67 | −13.06 | −53.13 | −48.53 | 35.74 |
| 80% | L* | 1.40 | 82.36 | 40.77 | 43.30 | 16.84 | 56.07 | 45.27 |
| | a* | 0.34 | −3.98 | 61.17 | 70.22 | 36.65 | −33.89 | −76.39 |
| | b* | 0.57 | 97.96 | 55.24 | −16.55 | −55.39 | −46.81 | 39.08 |
| 70% | L* | 4.50 | 83.41 | 44.13 | 46.80 | 22.22 | 59.60 | 49.89 |
| | a* | 0.81 | −5.89 | 57.40 | 67.81 | 33.71 | −34.63 | −73.79 |
| | b* | 2.03 | 95.77 | 54.47 | −19.44 | −55.80 | −44.11 | 41.63 |
| 60% | L* | 10.35 | 84.47 | 48.63 | 51.40 | 29.92 | 63.81 | 55.23 |
| | a* | 1.14 | −7.74 | 51.22 | 62.87 | 28.70 | −34.03 | −67.48 |
| | b* | 3.72 | 90.03 | 51.96 | −21.17 | −53.45 | −40.24 | 43.70 |
| 50% | L* | 20.04 | 85.70 | 54.07 | 56.96 | 38.46 | 67.96 | 60.62 |
| | a* | 0.96 | −9.57 | 43.29 | 56.18 | 23.18 | −32.35 | −61.35 |
| | b* | 3.75 | 82.24 | 48.48 | −21.68 | −49.27 | −35.82 | 43.29 |
| 40% | L* | 32.03 | 87.06 | 60.37 | 63.32 | 48.02 | 72.33 | 66.26 |
| | a* | 0.68 | −10.49 | 34.30 | 47.38 | 17.24 | −29.57 | −53.77 |
| | b* | 3.52 | 67.52 | 42.71 | −20.67 | −43.69 | −30.87 | 38.94 |
| 30% | L* | 44.58 | 88.47 | 67.52 | 69.98 | 57.61 | 76.95 | 72.18 |
| | a* | 0.31 | −10.45 | 25.36 | 37.82 | 12.38 | −25.46 | −44.53 |
| | b* | 2.82 | 52.11 | 32.00 | −18.66 | −37.07 | −25.11 | 30.46 |
| 20% | L* | 61.34 | 90.04 | 75.54 | 77.65 | 68.94 | 82.55 | 79.40 |
| | a* | −0.32 | −8.48 | 16.42 | 25.44 | 7.07 | −18.76 | −30.71 |
| | b* | 1.12 | 32.55 | 19.23 | −14.71 | −27.72 | −17.33 | 18.52 |
| 10% | L* | 76.21 | 91.28 | 83.58 | 85.06 | 80.58 | 87.86 | 86.18 |
| | a* | −0.68 | −5.74 | 7.58 | 12.52 | 2.70 | −10.59 | −16.12 |
| | b* | −0.32 | 16.92 | 8.99 | −9.05 | −15.99 | −9.60 | 8.74 |

TABLE 9

| | K | Y | Y + M | M | M + C | C | C + Y |
|---|---|---|---|---|---|---|---|
| 100% | 0.07 | 0.93 | 0.15 | 0.57 | 0.93 | 0.62 | 0.83 |
| 90% | 0.14 | 1.09 | 0.70 | 0.49 | 0.08 | 0.58 | 0.90 |
| 80% | 0.02 | 1.47 | 0.63 | 0.57 | 0.47 | 0.47 | 1.08 |
| 70% | 1.22 | 1.40 | 0.33 | 0.95 | 0.55 | 0.52 | 0.76 |
| 60% | 0.60 | 2.53 | 1.31 | 0.93 | 0.70 | 0.42 | 0.67 |
| 50% | 2.98 | 2.70 | 1.70 | 0.72 | 0.56 | 0.45 | 1.21 |
| 40% | 2.07 | 4.11 | 1.73 | 0.85 | 0.91 | 0.32 | 1.39 |

TABLE 9-continued

| | K | Y | Y + M | M | M + C | C | C + Y |
|---|---|---|---|---|---|---|---|
| 30% | 0.84 | 2.53 | 1.91 | 0.77 | 1.06 | 0.56 | 0.81 |
| 20% | 0.52 | 1.10 | 0.48 | 0.89 | 0.63 | 0.45 | 0.34 |
| 10% | 0.62 | 0.16 | 0.55 | 0.30 | 0.63 | 0.45 | 0.78 |

As shown in Tables 7 through 9 and FIGS. 14A and 14B and FIG. 15, the hue level in Example 5 is, though slightly different from each other, almost the same level in the "L*a*b*" color space as that of Comparison Example 5.

Example 6

In Example 6, variation of reflection density from the printed face is observed when the inkjet printer 1 is used and ink has been dried. In Example 6, respective inks of "K", "C", "M", "Y", "C"+"Y", "M"+"Y" and "C"+"M" are used and the respective inks are printed with a print density in a range of 10% to 100% at a 10% interval. Further, Reference example 6 for comparing with Example 6 is printed by a conventional inkjet printer. Experiment conditions are the same as those in Example 5.

Figure 16A:
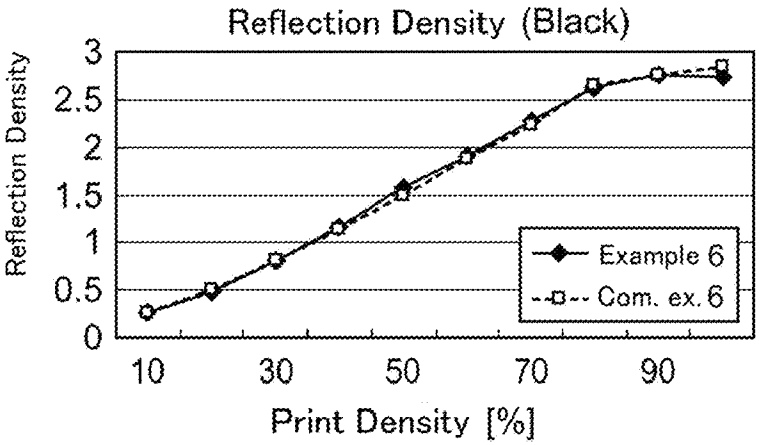
FIGS. 16A through 16D are graphs showing experimental results of reflection densities in Example 6 and Comparison example 6, with FIG. 16A showing the reflection density of "K", FIG. 16B showing the reflection density of "C", FIG. 16C showing the reflection density of "M", and FIG. 16D showing the reflection density of "Y"
Figure 16B:
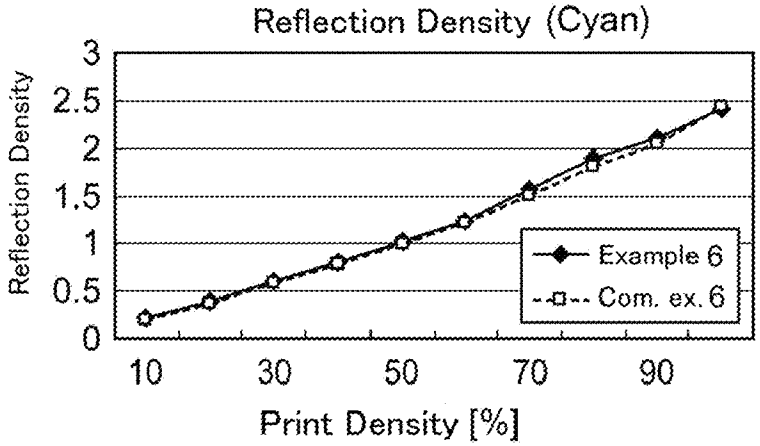
Figure 16C:
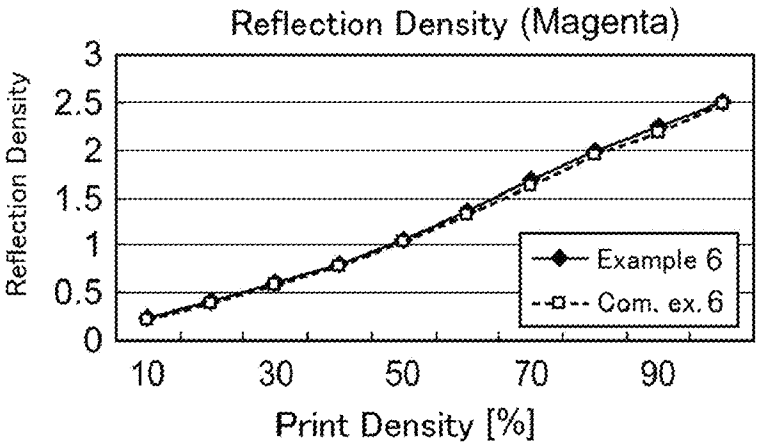
Figure 16D:
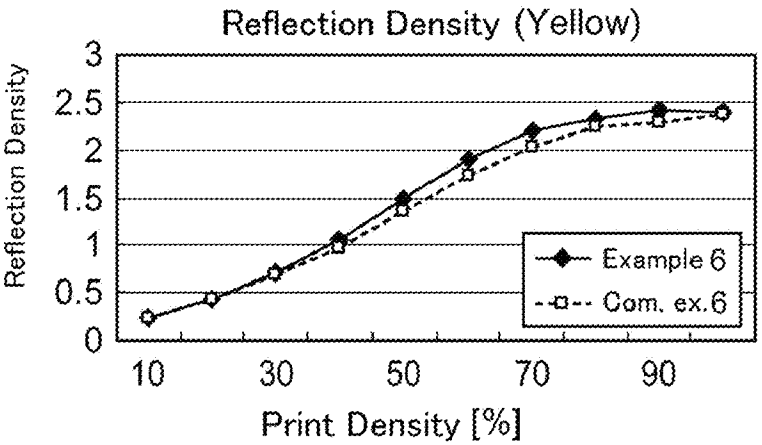
Figure 17A:
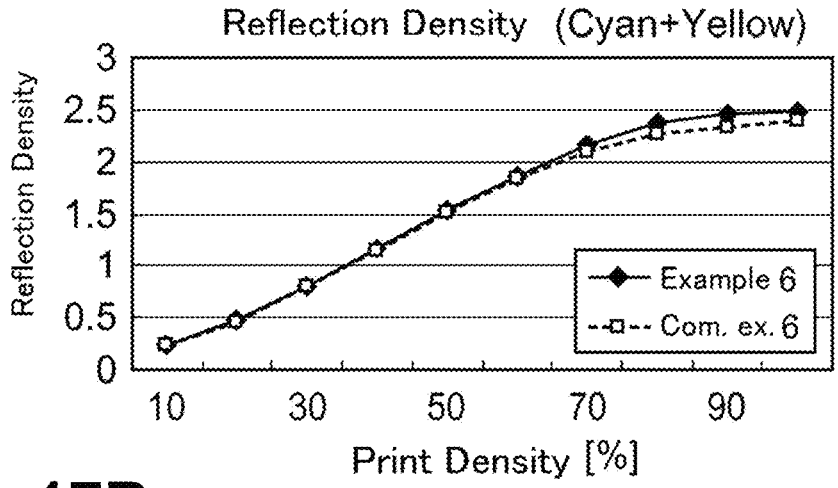
FIGS. 17A, 17B, and 17C are graphs showing experimental results of reflection densities in Example 6 and Comparison example 6, with FIG. 17A showing the reflection density of "C"+"Y", FIG. 17B showing the reflection density of "M"+"Y", and FIG. 17C showing the reflection density of "C"+"M"
Figure 17B:
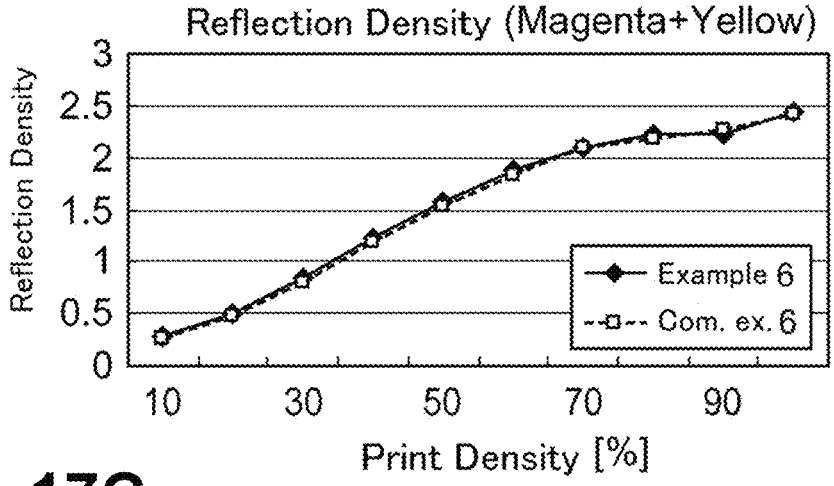
Figure 17C:
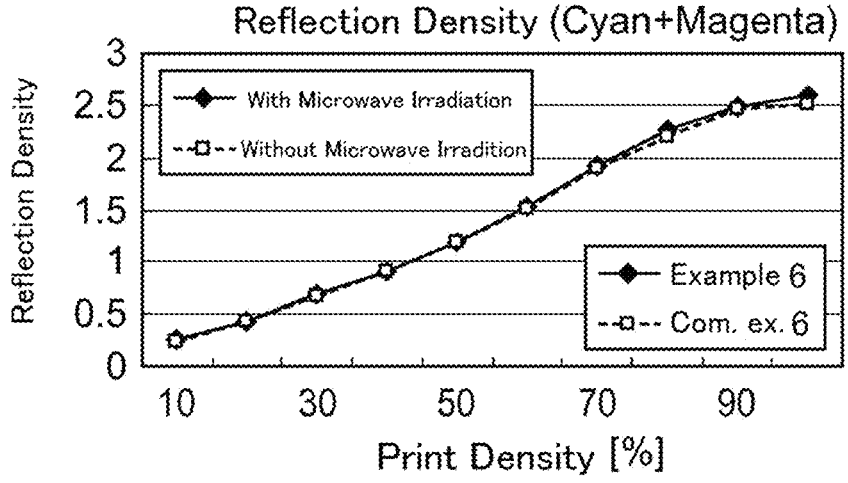

Experiment results of the reflection density in Example 6 are shown in Table 10, experiment results of the reflection density in Comparison example 6 are shown in Table 11, and differences of reflection densities between Example 6 and Comparison example 6 are shown in Table 12. Further, reflection densities in Example 6 and Comparison example 6 are shown in FIGS. 16 and 17. FIG. 16A is a graph showing the reflection density of "K", FIG. 16B is a graph showing the reflection density of "C", FIG. 16C is a graph showing the reflection density of "M" and FIG. 16D is a graph showing the reflection density of "Y". Further, FIG. 17A is a graph showing the reflection density of "C"+"Y", FIG. 17B is a graph showing the reflection density of "M"+"Y", and FIG. 17C is a graph showing the reflection density of "C"+"M".

TABLE 10

| | K | C | M | Y | C + Y | M + Y | C + M |
|---|---|---|---|---|---|---|---|
| 100% | 2.73 | 2.40 | 2.51 | 2.40 | 2.49 | 2.43 | 2.58 |
| 90% | 2.75 | 2.12 | 2.24 | 2.42 | 2.47 | 2.23 | 2.48 |
| 80% | 2.62 | 1.89 | 1.98 | 2.32 | 2.36 | 2.22 | 2.26 |
| 70% | 2.28 | 1.57 | 1.68 | 2.20 | 2.15 | 2.09 | 1.92 |
| 60% | 1.91 | 1.25 | 1.35 | 1.89 | 1.86 | 1.87 | 1.54 |
| 50% | 1.57 | 1.01 | 1.05 | 1.49 | 1.53 | 1.57 | 1.20 |
| 40% | 1.16 | 0.80 | 0.80 | 1.06 | 1.17 | 1.23 | 0.91 |
| 30% | 0.80 | 0.60 | 0.60 | 0.72 | 0.80 | 0.85 | 0.68 |
| 20% | 0.49 | 0.40 | 0.40 | 0.44 | 0.47 | 0.49 | 0.44 |
| 10% | 0.26 | 0.22 | 0.23 | 0.24 | 0.24 | 0.27 | 0.25 |

TABLE 11

| | K | C | M | Y | C + Y | M + Y | C + M |
|---|---|---|---|---|---|---|---|
| 100% | 2.84 | 2.44 | 2.49 | 2.37 | 2.39 | 2.42 | 2.50 |
| 90% | 2.75 | 2.04 | 2.19 | 2.30 | 2.34 | 2.26 | 2.45 |
| 80% | 2.64 | 1.81 | 1.94 | 2.24 | 2.27 | 2.18 | 2.21 |
| 70% | 2.23 | 1.50 | 1.62 | 2.04 | 2.10 | 2.09 | 1.89 |
| 60% | 1.88 | 1.22 | 1.32 | 1.72 | 1.83 | 1.84 | 1.50 |
| 50% | 1.48 | 0.99 | 1.03 | 1.36 | 1.51 | 1.53 | 1.18 |
| 40% | 1.13 | 0.78 | 0.78 | 0.97 | 1.15 | 1.19 | 0.90 |
| 30% | 0.82 | 0.59 | 0.58 | 0.68 | 0.79 | 0.80 | 0.66 |
| 20% | 0.51 | 0.38 | 0.38 | 0.42 | 0.46 | 0.48 | 0.43 |
| 10% | 0.27 | 0.20 | 0.21 | 0.24 | 0.24 | 0.25 | 0.24 |

TABLE 12

| | K | C | M | Y | C + Y | M + Y | C + M |
|---|---|---|---|---|---|---|---|
| 100% | −0.11 | −0.04 | 0.02 | 0.03 | 0.10 | 0.01 | 0.08 |
| 90% | 0.00 | 0.07 | 0.06 | 0.12 | 0.13 | −0.03 | 0.03 |
| 80% | −0.02 | 0.08 | 0.05 | 0.08 | 0.09 | 0.04 | 0.05 |
| 70% | 0.06 | 0.07 | 0.06 | 0.16 | 0.05 | 0.00 | 0.03 |
| 60% | 0.03 | 0.03 | 0.04 | 0.17 | 0.03 | 0.03 | 0.03 |
| 50% | 0.08 | 0.02 | 0.02 | 0.13 | 0.03 | 0.05 | 0.01 |
| 40% | 0.02 | 0.02 | 0.02 | 0.10 | 0.03 | 0.03 | 0.01 |

TABLE 12-continued

| | K | C | M | Y | C + Y | M + Y | C + M |
|---|---|---|---|---|---|---|---|
| 30% | −0.01 | 0.01 | 0.02 | 0.04 | 0.01 | 0.04 | 0.02 |
| 20% | −0.03 | 0.02 | 0.02 | 0.02 | 0.01 | 0.01 | 0.01 |
| 10% | −0.01 | 0.02 | 0.02 | 0.01 | 0.00 | 0.02 | 0.01 |

As shown in Tables 10 through 12 and FIGS. 16 and 17, there is little difference in the reflection density between Example 6 and Comparison example 6.

Example 7

In Example 7, a dried state is observed when the inkjet printer 1 is used and ink has been dried. In Example 7, "JV5" made by MIMAKI ENGINEERING CO., LTD is used and "ES3" ink and "ECO-HS1" ink are used for printing. Further, Reference example 7 for comparing with Example 7 is printed by a conventional inkjet printer.

Experiment conditions are as follows.

(1) Used ink: ES3 ink, Eco-HS1 ink (solvent ink)
(2) Medium: White polyvinyl chloride glossy (middle term)
(3) Printing condition: 720×1080 dpi-Hi-Bi 300% Solid printing
(4) Winding torque for medium: Maximum
(5) Pre-heater: 50° C.
(6) Print heater: 40° C.
(7) Drying conditions:

Example 7

Microwave irradiation by magnetron
Electric power of magnetron: 700 W
Blowing by fan
Quantity of blowing air: Mild blowing mode (2.37 $m^3$/min)
Air temperature: Hot air (Heater ON: 46 to 47° C.)
Rotation speed of the propeller member: 3 rpm Comparison Example 7

After-heater+natural drying (left to stand for 24 hours)
Temperature of after-heater: 50° C.
(8) Termination:
Reflection termination by the propeller member (4.5V)

The blocking and uneven drying are confirmed by visual inspection in order to evaluate the dried state.

Evaluation of the blocking is represented with the following numerical values as a score, i.e., from the lowest occurrence degree of the blocking, "5" (no occurrence), "4" (little occurrence), "3" (little occurrence in whole), "2" (much occurrence in whole) and "1" (occurrence of offset)

Evaluation of the uneven drying is represented with the following numerical values as a score, i.e., from the lowest occurrence degree of the uneven drying, "5" (uniform irradiation), "4" (wide streak occurred), "3" (narrow streak occurred), "2" (dots occurred) and "1" (no rear gore).

Experiment results of the example 7 are shown in Table 13. Table 13 shows occurring states of the blocking and the uneven drying for the respective inks.

TABLE 13

| Ink | Pass Number | Setting | Speed [cm/min] | Irradiation Time [sec] | Blocking | Uneven Drying |
|---|---|---|---|---|---|---|
| ES3 | 48 | Bi Hi | 5.1 | 127 | 5 | 5 |
| | 24 | Bi Hi | 10.1 | 64 | 5 | 4 |
| | 12 | Bi Hi | 20 | 32 | 2 | 3 |
| | 6 | Bi | 21.3 | 30 | 2 | 2 |

TABLE 13-continued

| Ink | Pass Number | Setting | Speed [cm/min] | Irradiation Time [sec] | Blocking | Uneven Drying |
|---|---|---|---|---|---|---|
| Eco-HS1 | 24 | Bi Hi | 10.1 | 64 | 5 | 5 |
| | 12 | Bi Hi | 19.6 | 33 | 4 | 4 |
| | 6 | Bi Hi | 36.9 | 18 | 3 | 3 |
| | 3 | Bi | 40.5 | 16 | 3 | 2 |

As shown in Table 13, the dried state is more satisfactory and the uneven drying is further suppressed with the longer irradiation time period of the microwave. This may be attained because, when the irradiation time period of the microwave is made longer, heat is transmitted through the ink from the standing wave to enhance the drying efficiency. In a case that "JV5" is used, it is desirable that the microwave irradiation time period is 64 seconds or longer per unit area.

When the printing speed is reduced (10 cm/min or less), steam is occurred. This may be occurred by evaporation of the solvent. Further, even in Comparison example 7, the printed face is turned to be a whitely cloudiness state as being dried. This may be due to characteristics of the ink.

Example 8

In Example 8, dried states depending on differences of the medium feeding speeds when the inkjet printer 1 is used are observed. In Example 8, "JV5" and "JV33" both of which are made by MIMAKI ENGINEERING CO., LTD are used for printing. Further, Reference example 8 for comparing with Example 8 is printed by a conventional inkjet printer.

Experiment conditions are as follows.

(1) Used ink: Eco-HS1 ink (solvent ink)
(2) Medium: White polyvinyl chloride glossy (middle term)
(3) Printing condition: 540×1080 dpi-6,12,24-Hi-Bi 300% Solid printing
(4) Winding torque for medium: Maximum
(5) Pre-heater: 35° C.
(6) Print heater: 35° C.
(7) Drying conditions:

Example 8-1

Microwave irradiation by magnetron
Electric power of magnetron: 0 W
Blowing by fan
Quantity of blowing air: Mild blowing mode (2.37 $m^3$/min)
Air temperature: Hot air (Heater ON: 46 to 47° C.)

Example 8-2

Microwave irradiation by magnetron
Electric power of magnetron: 300 W
Blowing by fan
Quantity of blowing air: Mild blowing mode (2.37 $m^3$/min)
Air temperature: Hot air (Heater ON: 46 to 47° C.)

Example 8-3

Microwave irradiation by magnetron
Electric power of magnetron: 400 W
Blowing by fan
Quantity of blowing air: Mild blowing mode (2.37 $m^3$/min)
Air temperature: Hot air (Heater ON: 46 to 47° C.)

Example 8-4

Microwave irradiation by magnetron
Electric power of magnetron: 500 W
Blowing by fan
Quantity of blowing air: Mild blowing mode (2.37 $m^3$/min)
Air temperature: Hot air (Heater ON: 46 to 47° C.)

Example 8-5

Microwave irradiation by magnetron
Electric power of magnetron: 600 W
Blowing by fan
Quantity of blowing air: Mild blowing mode (2.37 $m^3$/min)
Air temperature: Hot air (Heater ON: 46 to 47° C.)

Example 8-6

Microwave irradiation by magnetron
Electric power of magnetron: 700 W
Blowing by fan
Quantity of blowing air: Mild blowing mode (2.37 $m^3$/min)
Air temperature: Hot air (Heater ON: 46 to 47° C.)

Comparison Example 8

After-heater+natural drying (left to stand for 24 hours)
Temperature of after-heater: 50° C.
(8) Termination:
Reflection termination by the propeller member (4.5V)
Rotation speed of the propeller member: 3 rpm In order to evaluate the dried state, a weight difference of media is measured and the blocking and uneven drying are confirmed by visual inspection when the inkjet printer 1 is used and the ink has been dried.

A weight difference of the media is measured by subtracting a medium weight (g) before printing from a medium weight (g) after the microwave irradiation.

Evaluation of the blocking is represented with the following numerical values as a score, i.e., from the lowest occurrence degree of the blocking, "5" (no occurrence), "4" (little occurrence), "3" (little occurrence in whole), "2" (much occurrence in whole) and "1" (occurrence of offset).

Evaluation of the uneven drying is represented with the following numerical values as a score, i.e., from the lowest occurrence degree of the uneven drying, "5" (uniform irradiation), "4" (wide streak occurred), "3" (narrow streak occurred), "2" (dots occurred) and "1" (no rear gore).

Figure 18:
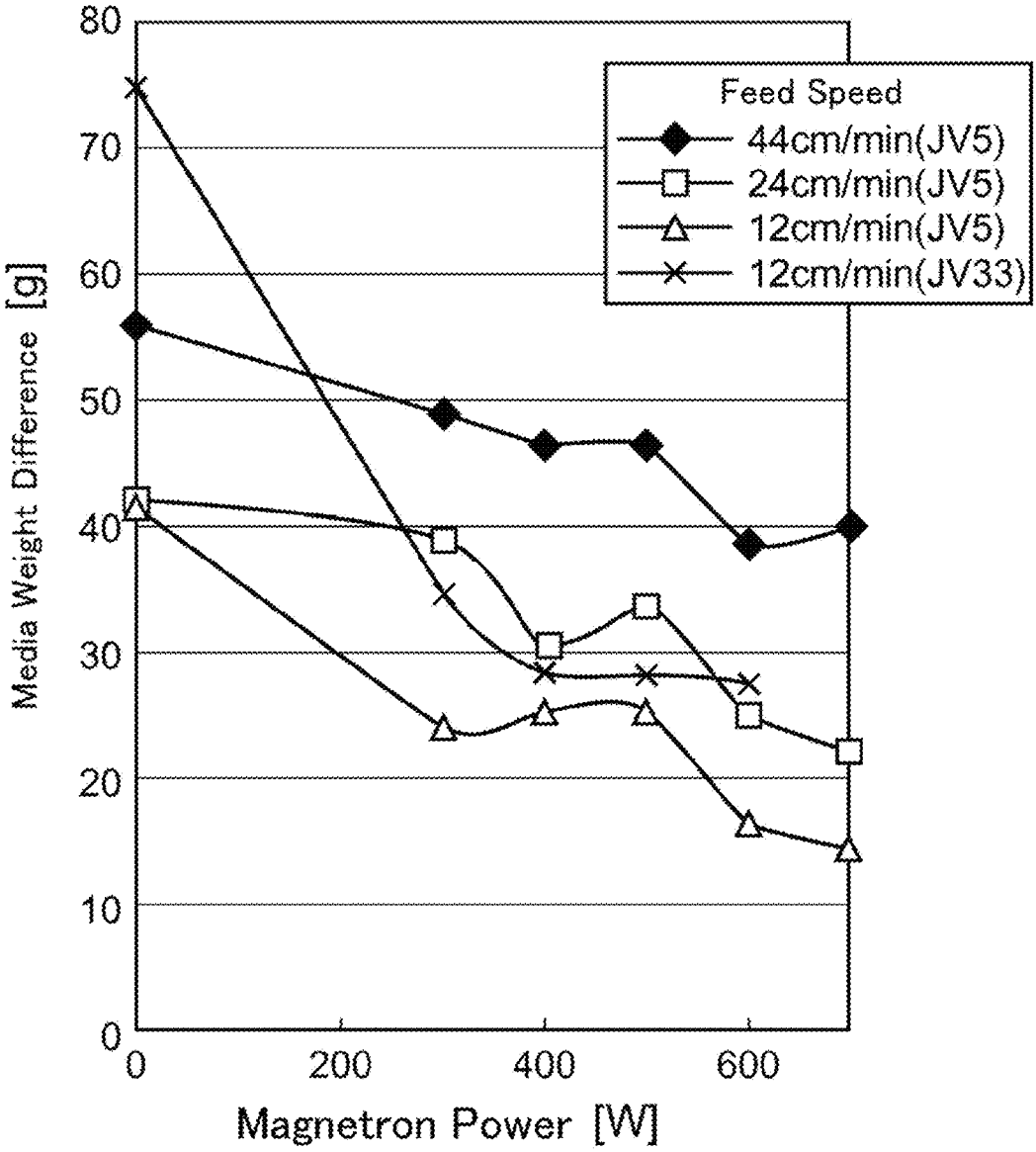
FIG. 18 is a graph showing relationships between magnetron powers and media weight differences for respective feeding speeds in Example 8.

Experiment results of Example 8 are shown in Tables 14 through 17 and FIG. 18. Table 14 represents a relationship between the feeding speed of a medium and the irradiation time period of the microwave per unit area, Table 15 represents weight differences of media, Table 16 represents the blocking evaluations, and Table 17 represents the uneven drying evaluations. Further, FIG. 18 is a graph showing relationships between magnetron powers and media weight differences for respective feeding speeds in Example 8.

TABLE 14

| | Printing Apparatus | | | |
|---|---|---|---|---|
| | JV5 | | | JV33 |
| Pass Number | 6 | 12 | 24 | 6 |
| Feed Speed | 44 cm/min | 24 cm/min | 12 cm/min | 12 cm/min |
| Microwave Irradiation Time per Unit Area | 15 sec | 27 sec | 54 sec | 54 sec |

TABLE 15

| | Power | JV5 | | | |
|---|---|---|---|---|---|
| | [W] | 6 Pass | 12 Pass | 24 Pass | JV33 |
| Example 8-1 | 0 | 55.71 | 42.15 | 41.62 | 74.62 |
| Example 8-2 | 300 | 48.89 | 38.81 | 23.86 | 34.47 |
| Example 8-3 | 400 | 46.55 | 30.35 | 25.27 | 28.48 |
| Example 8-4 | 500 | 46.09 | 33.19 | 25.22 | 28.14 |
| Example 8-5 | 600 | 38.70 | 24.80 | 16.57 | 27.33 |
| Example 8-6 | 700 | 39.92 | 22.01 | 16.44 | — |
| Comparison 8 | — | 20.35 | 13.76 | 15.73 | 19.85 |

TABLE 16

| | Power | JV5 | | | |
|---|---|---|---|---|---|
| | [W] | 6 Pass | 12 Pass | 24 Pass | JV33 |
| Example 8-1 | 0 | 1 | 1 | 1 | 1 |
| Example 8-2 | 300 | 1 | 3 | 2 | 2 |
| Example 8-3 | 400 | 2 | 3 | 4 | 2 |
| Example 8-4 | 500 | 1 | 3 | 5 | 4 |
| Example 8-5 | 600 | 1 | 4 | 5 | 5 |
| Example 8-6 | 700 | 1 | 4 | 5 | — |
| Comparison 8 | — | 2 | 2 | 2 | 5 |

TABLE 17

| | Power | JV5 | | | |
|---|---|---|---|---|---|
| | [W] | 6 Pass | 12 Pass | 24 Pass | JV33 |
| Example 8-1 | 0 | — | — | — | — |
| Example 8-2 | 300 | 1 | 1 | 1 | 1 |
| Example 8-3 | 400 | 1 | 1 | 3 | — |
| Example 8-4 | 500 | 1 | 1 | 4 | 1 |
| Example 8-5 | 600 | 1 | 3 | 5 | 5 |
| Example 8-6 | 700 | 1 | 4 | 5 | — |
| Comparison 8 | — | — | — | — | — |

As shown in Tables 14 through 17 and FIG. 18, when the feeding speed of the medium is lowered to elongate the microwave irradiation time period or, when the microwave irradiation quantity per unit area is increased at the time of high-speed printing, the dried state becomes satisfactory. Further, in the "JV5", the dried state becomes satisfactory in the following cases: (1) the medium feeding speed is 12 cm/min or less, (2) the microwave irradiation time period per unit area is 54 sec (second) or more, and (3) the magnetron drive electric power is 600 W or more.

As a result, it is desirable that the medium feeding speed is 12 cm/min or less and the microwave irradiation quantity per unit area is 600 W or more. Further, heat is further transmitted through the ink from the standing wave as the microwave irradiation time period is increased and the drying efficiency is enhanced. Further, in order to cope with high-speed printing, the microwave irradiation quantity per unit area is required to be increased.

According to the inkjet printer 1 in accordance with the embodiment described above, when the ink is ejected onto the medium "M" from the inkjet head 23, the medium "M" is inserted into the waveguide 30 to which the microwave is supplied by the magnetron 43. Further, after the microwave supplied by the magnetron 43 has been propagated through the waveguide 30, the microwave is reflection-terminated by the propeller part 61 of the propeller member 60 in the rotating reflection part 37. Therefore, the ink ejected onto the medium "M" is dried again by the reflected microwave. Further, the inside of the waveguide 30 is ventilated by the ventilation parts 38 and 39 through the fans 72 and 82. Therefore, the solvent vapor of the ink which is vaporized by irradiation of the microwave is forcibly discharged to the outside of the waveguide 30 and thus the drying speed of the ink ejected onto the medium "M" is improved. In addition, when the motor part 62 is rotated, the reflection direction of the microwave reflected by the propeller part 61 is changed and thus the standing wave generated by the microwave supplied by the magnetron 43 and the microwave reflected by the propeller part 61 is varied. Therefore, the peak position of the standing wave is varied in the inside of the waveguide 30 and thus uneven drying of the ink ejected onto the medium "M" is suppressed.

Further, the ventilation parts 38 and 39 provided with the fans 72 and 82 are disposed at the starting end part and the terminal end part of the waveguide 30 and thus the flow of gas in the inside of the waveguide 30 is made uniform and the uneven drying of the ink is suppressed.

Further, since hot air is sent into the waveguide 30 by the fans 72 and 82, the drying speed of the ink is further improved and, in addition, since the hot air is sent into the waveguide 30 so that its inside temperature is set in the range of 40° C. to 60° C., overheat due to the hot air is prevented and the drying speed of the ink is improved.

Further, since the microwave generated through the electric power of 400 W or more by the magnetron 43 is supplied to the waveguide 30, drying speed of the ink is further improved and a residual quantity of the ink can be reduced effectively.

Although a specific embodiment of the present invention has been shown and described, various changes and modifications will be apparent to those skilled in the art from the teachings herein. For example, in the embodiment described above, the fan 72 is provided in the ventilation part 38, which is disposed between the matching part 36 and the waveguide main body 31, and the fan 82 is provided in the ventilation part 39 which is disposed between the waveguide main body 32 and the rotating reflection part 37. However, the fans 72 and 82 may be provided at any position where the insertion openings 41 and 42 of the waveguide main body 31 and 32 are sandwiched by the fans 72 and 82. Further, the number of the fans is not limited in the embodiment of the present invention. For example, a pair of fans may be provided at both end parts of the waveguide main body 31 and another pair of fans may be provided at both end parts of the waveguide main body 32.

Further, in the embodiment described above, the propeller part 61 is formed in a flat plate shape in which two blades are extended to both directions with the rotation output shaft 63 as a center and the propeller part 61 is rotated with the axis in the perpendicular direction to the carrying direction "D2" of the microwave as a center axis. However, the shape and the rotating direction of the propeller part 61 may be changed in any shape and direction.

Further, in the embodiment described above, the microwave which is not reflected by the propeller part 61 in the rotating reflection part 37 is terminated by the short-circuiting plate 90. However, for example, a reflection terminal end part for reflecting microwave may be provided in a succeeding stage of the rotating reflection part 37 and the microwave is further reflected by the reflection terminal end part.

Further, in the embodiment described above, two-stage waveguide is used but one stage waveguide may be used and a waveguide having three or more stages may be utilized.

The embodiment of the present invention may be applicable to an inkjet printer in which ink is ejected to form image or the like on a medium.

According to the inkjet printer in accordance with the embodiment of the present invention, a medium onto which ink is ejected by the ejecting means is inserted into the waveguide to which an electromagnetic wave is supplied by the electromagnetic wave supply means. Therefore, the ink which is ejected onto a medium is dried by the electromagnetic wave. Further, the electromagnetic wave which is supplied by the electromagnetic wave supply means is, after having propagated through the waveguide, reflected at the terminal end part by the rotating reflector and thus the ink ejected onto the medium is dried again by the reflected electromagnetic wave. In addition, since the inside of the waveguide is ventilated by the ventilation means, solvent vapor of the ink vaporized by the electromagnetic wave is forcibly discharged to the outside of the waveguide and thus a drying speed of the ink ejected onto the medium is improved. Moreover, since the rotating reflector is rotated, the reflection direction of the electromagnetic wave which is reflected by the rotating reflector is varied and thus the standing wave which is generated by the electromagnetic wave supplied by the electromagnetic wave supply means and the electromagnetic wave reflected by the rotating reflector is varied. Therefore, the peak position of the standing wave is varied in the inside of the waveguide and thus uneven drying of the ink ejected onto the medium is suppressed.

In this case, it is preferable that the ventilation means is provided at a starting end part and a terminal end part of the waveguide. According to this inkjet printer, since the ventilation means is provided at the starting end part and the terminal end part of the waveguide, flow of gas in the inside of the waveguide is made uniform and uneven drying of the ink is suppressed.

Further, it is preferable that hot air is sent into the waveguide by the ventilation means. According to this inkjet printer, since the hot air is sent into the waveguide, drying speed of the ink is further improved.

In this case, it is preferable that temperature of the hot air is set in a range of 40° C. TO 60° C. According to this inkjet printer, since the hot air whose temperature is set in a range of 40° C. TO 60° C. is sent into the waveguide, overheating by the hot air is prevented and the drying speed of the ink is further improved.

Further, it is preferable that the electromagnetic wave supply means supplies the electromagnetic wave, which is generated with electric power of 400 W or more, to the waveguide. According to this inkjet printer, since the electromagnetic wave generated with electric power of 400 W or more is supplied to the waveguide, the drying speed of the ink is improved.

According to the embodiment of the present invention, in an inkjet printer in which a waveguide is used, drying speed of ink that is ejected onto a medium is improved.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An inkjet printer comprising:

an ejector to eject an organic solvent ink onto a medium made of vinyl chloride;

a waveguide configured to allow the medium onto which the organic solvent ink was ejected to pass through the waveguide, the waveguide comprising:

a first waveguide main body including a starting end part and a first insertion opening though which the medium is to pass along a vertical direction;

a second waveguide main body including a terminal end part and a second insertion opening through which the medium is to pass along the vertical direction, the first and second waveguide main bodies being arranged in the vertical direction; and a bent part having a substantially U-shape and connecting the first waveguide main body with the second waveguide main body;

an electromagnetic wave supplier provided at the starting end part of the waveguide to supply an electromagnetic wave to the waveguide;

a rotating reflector provided at the terminal end part of the waveguide and being rotatable to reflect the electromagnetic wave supplied by the electromagnetic wave supplier; and a ventilator to ventilate an inside of the waveguide.

2. The inkjet printer according to claim 1, wherein the ventilator is provided at the starting end part and the terminal end part of the waveguide.

3. The inkjet printer according to claim 2, wherein hot air is sent into the waveguide by the ventilator.

4. The inkjet printer according to claim 3, wherein temperature of the hot air is set in a range of 40° C. to 60° C.

5. The inkjet printer according to claim 4, wherein the electromagnetic wave supplied by the electromagnetic wave supplier to the waveguide is generated with electric power of 400W or more.

6. The inkjet printer according to claim 2, wherein the electromagnetic wave supplied by the electromagnetic wave supplier to the waveguide is generated with electric power of 400W or more.

7. The inkjet printer according to claim 3, wherein the electromagnetic wave supplied by the electromagnetic wave supplier to the waveguide is generated with electric power of 400W or more.

8. The inkjet printer according to claim 1, wherein hot air is sent into the waveguide by the ventilator.

9. The inkjet printer according to claim 8, wherein temperature of the hot air is set in a range of 40° C. to 60° C.

10. The inkjet printer according to claim 9, wherein the electromagnetic wave supplied by the electromagnetic wave supplier to the waveguide is generated with electric power of 400W or more.

11. The inkjet printer according to claim 8, wherein the electromagnetic wave supplied by the electromagnetic wave supplier to the waveguide is generated with electric power of 400W or more.

12. The inkjet printer according to claim 1, wherein the electromagnetic wave supplied by the electromagnetic wave supplier to the waveguide is generated with electric power of 400W or more.

13. The inkjet printer according to claim 1, wherein the rotating reflector provided within the waveguide.

14. The inkjet printer according to claim 13, wherein the rotating reflector is configured to be rotatable about an axis that is perpendicular to a carrying direction of the electromagnetic wave through the terminal end part of the waveguide.

15. The inkjet printer according to claim 14, wherein the rotating reflector includes a planar plate that extends in a plane parallel to the axis.

16. The inkjet printer according to claim 1, wherein the rotating reflector is configured to be rotatable about an axis that is perpendicular to a carrying direction of the electromagnetic wave through the terminal end part of the waveguide.

17. The inkjet printer according to claim 16, wherein the rotating reflector includes a planar plate that extends in a plane parallel to the axis.

18. An inkjet printer comprising:

ejecting means for ejecting an organic solvent ink onto a medium made of vinyl chloride;

waveguide means configured to allow the medium onto which the organic solvent ink was ejected to pass through the waveguide means, the waveguide means comprising:

a first waveguide main body including a starting end part and a first insertion opening though which the medium is to pass along a vertical direction;

a second waveguide main body including a terminal end part and a second insertion opening through which the medium is to pass along the vertical direction, the first and second waveguide main bodies being arranged in the vertical direction; and a bent part having a substantially U-shape and connecting the first waveguide main body with the second waveguide main body;

electromagnetic wave supply means for supplying an electromagnetic wave to the waveguide means, the electromagnetic wave supply means being provided at the starting end part of the waveguide means;

rotating reflection means for reflecting the electromagnetic wave supplied by the electromagnetic wave supply means while being rotated, the reflection member means being provided at the terminal end part of the waveguide means; and ventilation means for ventilating an inside of the waveguide means.

19. The inkjet printer according to claim 18, wherein the rotating reflection means is provided within the waveguide means.

20. The inkjet printer according to claim 18, wherein the rotating reflection means is configured to be rotatable about an axis that is perpendicular to a carrying direction of the electromagnetic wave through the terminal end part of the waveguide means, and wherein the rotating reflection means includes a planar plate that extends in a plane parallel to the axis.

* * * * *